US007850396B2

(12) United States Patent
Pietila et al.

(10) Patent No.: US 7,850,396 B2
(45) Date of Patent: Dec. 14, 2010

(54) WHEELED SCREEDING DEVICE

(75) Inventors: Mark A. Pietila, Atlantic Mine, MI (US); Philip D. Halonen, Calumet, MI (US); Jason M. Wiitanen, Painesdale, MI (US); Jeffrey W. Torvinen, Toivola, MI (US)

(73) Assignee: Somero Enterprises, Inc., Fort Myers, FL (US)

( * ) Notice: Subject to any disclaimer, the term of this patent is extended or adjusted under 35 U.S.C. 154(b) by 0 days.

(21) Appl. No.: 12/345,164

(22) Filed: Dec. 29, 2008

(65) Prior Publication Data

US 2009/0175681 A1 Jul. 9, 2009

Related U.S. Application Data

(60) Provisional application No. 61/018,792, filed on Jan. 3, 2008.

(51) Int. Cl.
*E01C 19/38* (2006.01)

(52) U.S. Cl. ..... 404/96; 404/114; 404/118

(58) Field of Classification Search ..... 404/96, 404/97, 114, 118
See application file for complete search history.

(56) References Cited

U.S. PATENT DOCUMENTS

| | | | | |
|---|---|---|---|---|
| 791,726 | A | 6/1905 | Schutte | |
| 842,770 | A | 1/1907 | Connelly | |
| 1,695,202 | A | 12/1928 | Newell | |
| 1,955,101 | A | 4/1934 | Sloan | 94/48 |
| 2,009,542 | A | 7/1935 | Day | 94/45 |
| 2,032,205 | A | 2/1936 | Gage | 94/33 |
| 2,180,198 | A | 11/1939 | Day | 94/46 |
| 2,219,246 | A | 10/1940 | Jackson | 94/45 |
| 2,248,247 | A | 7/1941 | Nichols | 94/45 |
| 2,255,343 | A | 9/1941 | Baily | 94/45 |

(Continued)

FOREIGN PATENT DOCUMENTS

CA 2051776 12/1995

(Continued)

OTHER PUBLICATIONS

Engineering News-Record, Plymouth Locomotive Works, p. 78, May 26, 1949.

(Continued)

*Primary Examiner*—Gary S Hartmann
(74) *Attorney, Agent, or Firm*—Van Dyke, Gardner, Linn & Burkhart, LLP

(57) ABSTRACT

A method and apparatus for screeding post tensioned concrete slabs includes providing a screeding device having a wheeled support having a frame portion and spaced apart wheels rotatably mounted to the frame portion. The screeding device has a screed head mounted to the wheeled support. The screed head includes a vibrating member and a grade setting device adjustably mounted to the vibrating member. The vibrating member is at least partially supportable on the uncured concrete surface, and the grade setting device is adjustable relative to the vibrating member to strike off excess uncured concrete in front of the vibrating member to establish the desired grade or level of the uncured concrete. The screed head may be pivotable relative to the wheeled support about a longitudinal pivot axis extending along the screeding device and in the direction of travel of the screeding device.

25 Claims, 20 Drawing Sheets

U.S. PATENT DOCUMENTS

| | | | | |
|---|---|---|---|---|
| 2,296,453 | A | 9/1942 | Saffert | 25/155 |
| 2,303,335 | A | 12/1942 | Day | 94/24 |
| 2,314,985 | A | 3/1943 | Jackson | 94/45 |
| 2,373,828 | A | 4/1945 | Harrington | 94/45 |
| 2,378,065 | A | 6/1945 | Crock | 94/45 |
| 2,386,662 | A | 10/1945 | Crock | 94/45 |
| 2,400,321 | A | 5/1946 | Troxell | 94/45 |
| 2,449,851 | A | 9/1948 | Jackson | 94/45 |
| 2,453,510 | A | 11/1948 | Jackson | 94/48 |
| 2,492,431 | A | 12/1949 | Kroeckel | 259/1 |
| 2,584,459 | A | 2/1952 | Jackson | 94/48 |
| 2,599,330 | A | 6/1952 | Jackson | 94/48 |
| 2,651,980 | A | 9/1953 | Wells et al. | 94/48 |
| 2,746,367 | A | 5/1956 | Ferguson | 94/49 |
| 2,916,836 | A | 12/1959 | Stewart et al. | 37/143 |
| 3,067,656 | A | 12/1962 | Gustafsson | 94/45 |
| 3,088,384 | A | 5/1963 | Heer et al. | 94/46 |
| 3,095,789 | A | 7/1963 | Melvin et al. | 94/45 |
| 3,147,678 | A | 9/1964 | Lewis | 94/45 |
| 3,262,378 | A | 7/1966 | Schrimper et al. | 94/46 |
| 3,396,642 | A | 8/1968 | Martinson | 94/39 |
| 3,403,609 | A | 10/1968 | Bradshaw et al. | 94/46 |
| 3,406,761 | A | 10/1968 | Ryan | 172/42 |
| 3,412,658 | A | 11/1968 | Griffin | 94/45 |
| 3,427,939 | A | 2/1969 | Braff et al. | 94/48 |
| 3,540,360 | A | 11/1970 | Snow et al. | 94/46 |
| 3,681,484 | A | 8/1972 | McKie et al. | 264/34 |
| 3,838,933 | A | 10/1974 | Lehman et al. | 404/114 |
| 3,850,541 | A | 11/1974 | Baillet et al. | 404/114 |
| 3,871,788 | A | 3/1975 | Barsby | 404/117 |
| 3,883,259 | A | 5/1975 | Berg et al. | 404/120 |
| 3,918,214 | A | 11/1975 | Buschman | 51/170 |
| 4,043,694 | A | 8/1977 | Mullen | 404/133 |
| 4,224,003 | A | 9/1980 | St. Louis | 404/133 |
| 4,249,327 | A | 2/1981 | Allen | 404/114 |
| 4,256,416 | A | 3/1981 | Bishop | 404/119 |
| 4,314,773 | A | 2/1982 | Allen | 404/116 |
| 4,318,631 | A | 3/1982 | Vickers | 404/93 |
| 4,343,568 | A | 8/1982 | Kaltenegger | 404/133 |
| 4,349,295 | A | 9/1982 | Morrison | 404/114 |
| 4,359,296 | A | 11/1982 | Cronkhite | 404/114 |
| 4,375,351 | A | 3/1983 | Allen | 425/456 |
| 4,379,653 | A | 4/1983 | Brown | 404/118 |
| 4,386,901 | A | 6/1983 | Morrison | 425/456 |
| 4,388,018 | A | 6/1983 | Boschung | 404/113 |
| 4,408,978 | A | 10/1983 | Owens | 425/456 |
| 4,427,358 | A | 1/1984 | Stilwell | 425/432 |
| 4,431,336 | A | 2/1984 | Nightengale et al. | 404/97 |
| 4,449,845 | A | 5/1984 | Carrillo | 404/118 |
| 4,470,783 | A | 9/1984 | Friebel et al. | 425/62 |
| 4,499,779 | A | 2/1985 | Maass | 74/61 |
| 4,591,291 | A | 5/1986 | Owens | 404/118 |
| 4,614,486 | A | 9/1986 | Bragagnini | 425/62 |
| 4,641,995 | A | 2/1987 | Owens | 404/118 |
| 4,650,366 | A | 3/1987 | Morrison | 404/114 |
| 4,701,071 | A | 10/1987 | Morrison | 404/114 |
| 4,702,641 | A | 10/1987 | Naser et al. | 404/97 |
| 4,729,194 | A | 3/1988 | Maier et al. | 51/170 |
| 4,734,022 | A | 3/1988 | Shimabukuro | 425/62 |
| 4,752,156 | A | 6/1988 | Owens | 404/118 |
| 4,798,494 | A | 1/1989 | Allen | 404/114 |
| 4,838,730 | A | 6/1989 | Owens | 404/114 |
| 4,848,961 | A | 7/1989 | Rouillard | 404/114 |
| 4,856,932 | A | 8/1989 | Kraft | 404/118 |
| 4,861,188 | A | 8/1989 | Rouillard | 404/75 |
| 4,892,437 | A | 1/1990 | Kraft | 404/97 |
| 4,911,575 | A | 3/1990 | Tidwell | 404/97 |
| 5,016,319 | A | 5/1991 | Stigen | 16/114 |
| 5,039,249 | A | 8/1991 | Hansen et al. | 484/84 |
| 5,062,738 | A | 11/1991 | Owens | 404/114 |
| 5,080,525 | A | 1/1992 | Bricher et al. | 404/96 |
| 5,096,330 | A | 3/1992 | Artzberger | 404/97 |
| 5,129,803 | A | 7/1992 | Nomura et al. | 425/62 |
| 5,156,487 | A | 10/1992 | Haid | 404/72 |
| 5,190,401 | A | 3/1993 | Wilson | 404/118 |
| 5,234,283 | A | 8/1993 | Adkins | 404/97 |
| 5,244,305 | A | 9/1993 | Lindley | 404/97 |
| 5,279,501 | A | 1/1994 | Shelley | 404/118 |
| 5,288,166 | A | 2/1994 | Allen et al. | 404/84.1 |
| 5,328,295 | A | 7/1994 | Allen | 404/84.1 |
| 5,352,063 | A | 10/1994 | Allen et al. | 404/84.1 |
| 5,375,942 | A | 12/1994 | Lindley et al. | 404/97 |
| 5,540,519 | A | 7/1996 | Weber | 404/102 |
| 5,556,226 | A | 9/1996 | Hohmann, Jr. | 404/84.1 |
| 5,567,075 | A | 10/1996 | Allen | 404/84.5 |
| 5,676,489 | A | 10/1997 | Willhoite | 404/93 |
| 5,778,482 | A | 7/1998 | Sbrigato | 15/245.1 |
| 5,779,390 | A | 7/1998 | Tuusinen | 404/101 |
| 5,803,656 | A | 9/1998 | Turck | 404/103 |
| 5,807,022 | A | 9/1998 | McCleary | 404/97 |
| 5,857,803 | A | 1/1999 | Davis et al. | 404/102 |
| 5,924,819 | A | 7/1999 | Breidenbach | 404/96 |
| 5,984,571 | A | 11/1999 | Owens | 404/97 |
| 6,022,171 | A | 2/2000 | Munoz | 404/124 |
| 6,029,752 | A | 2/2000 | Young | 172/4.5 |
| 6,056,474 | A | 5/2000 | Nolan | 404/118 |
| 6,089,787 | A | 7/2000 | Allen et al. | 404/118 |
| 6,139,217 | A | 10/2000 | Reuter | 404/97 |
| 6,155,708 | A | 12/2000 | Lindley | 366/123 |
| 6,174,105 | B1 | 1/2001 | Holmes et al. | 404/104 |
| 6,200,065 | B1 | 3/2001 | Eitzen | 404/114 |
| 6,223,495 | B1 | 5/2001 | Shaw et al. | 52/749.1 |
| 6,231,331 | B1 | 5/2001 | Lievers | 425/183 |
| 6,238,135 | B1 | 5/2001 | Rower | 404/84.5 |
| D447,152 | S | 8/2001 | Cunningham et al. | D15/10 |
| 6,293,780 | B1 | 9/2001 | Rijkers | 425/456 |
| 6,296,467 | B1 | 10/2001 | Rouillard | 425/182 |
| 6,302,619 | B2 | 10/2001 | Fix | 404/84.1 |
| 6,322,286 | B1 | 11/2001 | Rijkers | 404/114 |
| 6,325,531 | B1 | 12/2001 | Lindley | 366/121 |
| 6,336,769 | B1 | 1/2002 | Cincis et al. | 404/118 |
| 6,623,208 | B2 | 9/2003 | Quenzi et al. | 404/84.8 |
| 6,685,390 | B1 | 2/2004 | Eitzen | 404/119 |
| 6,953,304 | B2 | 10/2005 | Quenzi et al. | 404/114 |
| 6,976,805 | B2 | 12/2005 | Quenzi et al. | 404/114 |
| 7,044,681 | B2 | 5/2006 | Quenzi et al. | 404/84.1 |
| 7,121,762 | B2 | 10/2006 | Quenzi et al. | |
| 7,175,363 | B2 | 2/2007 | Quenzi et al. | 404/84.1 |
| 7,195,423 | B2 | 3/2007 | Halonen et al. | |
| 7,320,558 | B2 | 1/2008 | Quenzi et al. | |
| 7,396,186 | B2 | 7/2008 | Quenzi et al. | |
| 7,407,339 | B2 | 8/2008 | Halonen et al. | |
| 7,491,011 | B2 * | 2/2009 | Quenzi et al. | 404/84.1 |
| 2001/0046179 | A1 | 11/2001 | Lindley | 366/121 |
| 2007/0116520 | A1 | 5/2007 | Quenzi et al. | |

FOREIGN PATENT DOCUMENTS

| | | |
|---|---|---|
| CH | 352485 | 4/1961 |
| DE | 42402 | 11/1965 |
| DE | 2019631 | 11/1971 |
| DE | 3046433 | 7/1982 |
| DE | 4138011 | 5/1993 |
| EP | 1312717 | 5/2003 |
| FR | 636563 | 4/1928 |
| FR | 1227346 | 3/1960 |
| FR | 1417130 | 10/1965 |
| FR | 1479494 | 3/1967 |
| FR | 2644806 | 3/1989 |
| GB | 308423 | 3/1929 |
| GB | 819621 | 9/1959 |
| IT | 358073 | 2/1938 |
| JP | 6306813 | 1/1994 |
| NO | 78783 | 7/1951 |

| | | |
|---|---|---|
| SE | 173454 | 11/1960 |
| SE | 176924 | 10/1961 |

OTHER PUBLICATIONS

Construction Methods, p. 21, Oct. 1964.

Whiteman Manufacturing Co., Portable Screeding Machines Brochure, Jun. 18, 1958.

Search Report and Written Opinion for PCT application PCT/US08/088440, which is the foreign counterpart to the present application.

* cited by examiner

WHEELED SCREEDING DEVICE

CROSS REFERENCE TO RELATED APPLICATION

The present application claims benefit of U.S. provisional application Ser. No. 61/018,792, filed Jan. 3, 2008, which is hereby incorporated by reference in its entirety.

BACKGROUND OF THE INVENTION

Residential concrete construction typically includes, for example, slab-on-grade floors for homes, basement floors, garage floors, sidewalks, patios, driveways and/or decorative concrete areas and/or the like. In some concrete slab applications, it is desirable to pre-stress the concrete to increase its load carrying capacity after it has been screeded and allowed to cure to the proper strength. Such an approach is known in the concrete industry as "post tensioned concrete" or "PT concrete". Post tensioning of the concrete enables longer free spans of concrete between points of substantial support or vertical columns in the case of elevated slabs, and makes possible the placement of on-grade slabs over soft ground and areas that have loose or sandy subsoil conditions that may eventually allow the slabs to crack or fail under working loads over time. Post tensioning of concrete slabs typically results in elevated and on-grade concrete slabs that can withstand greater live or working loads than non-pre-stressed concrete.

In such post tensioning applications, specially installed tensioning cables may be disposed along and periodically spaced within the concrete slab along with typical steel wire mesh and rebar prior to the placement and leveling of the uncured concrete. After the concrete has been screeded, finished, and cured to a sufficient level of strength, the internal post tensioning cables are pulled and thus tensioned using specially designed jacking devices at the perimeter end-faces of the concrete slab. Once the cables are tensioned to a predetermined amount of tensioning force, the ends of the cables are permanently secured to the perimeter end-faces of the concrete slab, transferring and evenly distributing the respective cable tension forces to the end faces of the slab. The jacking devices are then removed, maintaining the resulting compressive stresses generated within the cured concrete slab. The resulting compressive stresses within the concrete allow it to withstand significantly greater live working loads over time without cracking or potential failure occurring.

Typically, when screeding uncured concrete that includes post-tensioned cables, the use of manual screeding or hand-held screeding devices are preferred because such concrete screeding equipment does not tend to disturb the carefully placed and positioned post-tensioned cables that are installed to specific architectural and engineering dimensional specifications within the slab. The relatively greater weight of conventional structure-supported screeding equipment or wheeled equipment is likely to sink into the concrete, contacting and disturbing the locations of the post-tensioned cables within the uncured concrete. Use of such currently known and available automated and mechanized screeding machines on post tension concrete slabs is not recommended or even permitted in most instances. The excessive weight and complexity of these current state of the art machines can potentially interfere and disturb the post tensioning cables, and thus manual or hand-held screeding devices must typically be used. Such a manual screeding approach is known to be both labor intensive and time consuming.

SUMMARY OF THE INVENTION

Therefore, there is a need in the residential concrete construction industry for a small, compact, lightweight, laser controlled, wheel-driven concrete screeding machine that can reduce the effort, increase productivity, and improve accuracy and levelness quality of residential concrete slabs. Likewise, there is a comparable and corresponding need in the commercial concrete construction industry for a similar small laser-controlled screeding machine that can be readily used on elevated concrete decks, parking structures, and specific types of slab-on-grade concrete that often include post-tension steel reinforcement cables that are employed to increase the strength and load-holding characteristics of the concrete. The various design features and characteristics of the present invention combine to provide a viable and productive solution toward these types of needs and applications within the concrete construction industry.

The present invention provides an apparatus for screeding and vibrating uncured concrete (or may process sand, dirt, gravel and/or other materials) in areas which may be inaccessible to larger machines and equipment, such as due to the space limitations of residential concrete construction, small buildings, or the weight restrictions maintained during the construction of elevated decks and surfaces, such as post tensioned and/or pre-stressed concrete. The present invention provides a concrete strike-off and screeding device or screed head which is moved around, driven, and steered via human effort and/or driven wheels. The screed head includes a concrete surface working member or device, such as a vibrating member or beam, and a grade setting device or member or plow, and may utilize aspects of the screeding devices described in U.S. Pat. Nos. 6,976,805; 6,953,304; 7,121,762; 7,044,681; and/or 7,175,363, which are hereby incorporated herein by reference in their entireties.

According to an aspect of the present invention, a system and/or method of screeding post tensioned concrete slabs includes providing cables at a support surface, placing uncured concrete at the support surface, providing a lightweight screeding device comprising a wheeled support having a frame portion and a pair of spaced apart wheels rotatably mounted to the frame portion. The lightweight screeding device has a screed head mounted to the wheeled support, and the screed head comprises a vibrating member and a grade setting device adjustably mounted to the vibrating member. The vibrating member is at least partially supportable on the uncured concrete surface, and the grade setting device, such as a plow or the like, is adjustable relative to the vibrating member to at least one of establish and/or indicate a desired grade of the concrete surface. The lightweight screeding device is moved over and through the uncured concrete and over and upon the post-tensioned cables while the vibrating member is at least partially supported on a surface of the uncured concrete. The grade setting device is adjusted relative to the vibrating member to strike off excess uncured concrete in front of the vibrating member to establish the desired grade or level of the uncured concrete. The vibrating member is vibrated to screed the uncured concrete at the desired grade or level while the lightweight screeding device is moved over and through the uncured concrete and while the vibrating member is at least partially supported on the struck off surface of the uncured concrete. The post-tensioned cables are tensioned after the concrete has been placed, screeded, and sufficiently cured to a desired strength to pre-stress the concrete in compression to increase the load-holding capacity of the concrete slab. The post-tensioning of the cables may be carried out in a known manner, such as by pulling the cable end or ends and securing the ends of the cable to the perimeter end faces of the concrete slab or structure.

Optionally, the screed head may be pivotally mounted to the wheeled support and may be pivotable about a longitudinal pivot axis extending along the wheeled screeding device and in a direction of travel of the wheeled screeding device. The screed head may pivot about the longitudinal pivot axis relative to the body and/or frame of the wheeled support, such as relative to or at a lift arm that mounts the screed head to the wheeled support. The method may include pivoting the screed head about the longitudinal pivot axis to screed the concrete surface and follow a targeted grade elevation while the spaced apart wheels engage uneven terrain as the lightweight screeding device is moved over and through the uncured concrete.

The wheeled screeding device is partially balanced about the spaced apart wheels and may include at least one counterweight that is movable along a longitudinally oriented support or track or rail of the wheeled support. The method may include moving the at least one counterweight along the longitudinally oriented support to adjust a down pressure of the vibrating member at the uncured concrete surface.

Optionally, the spaced apart wheels may be rotatably driven via a single drive motor. The method may include controlling rotation of the spaced apart wheels via a transaxle drive unit that may be operable to rotatably drive the wheels at different speeds for steering the wheeled screeding device.

Therefore, the present invention provides a lightweight, easily maneuverable screeding device that is at least partially supported on the uncured concrete as it is moved over or through the uncured concrete surface by an operator. The relative small size and portability of this device makes it uniquely useful for many concrete construction site applications, such as pre-stressed, elevated slabs of concrete and/or the like, which may have post-tensioned cables within the concrete slabs, with the cables being tensioned after the concrete is placed, screeded and at least partially cured.

These and other objects, advantages, purposes and features of the present invention will become apparent upon review of the following specification in conjunction with the drawings.

DESCRIPTION OF THE PREFERRED EMBODIMENTS

Figure 1:
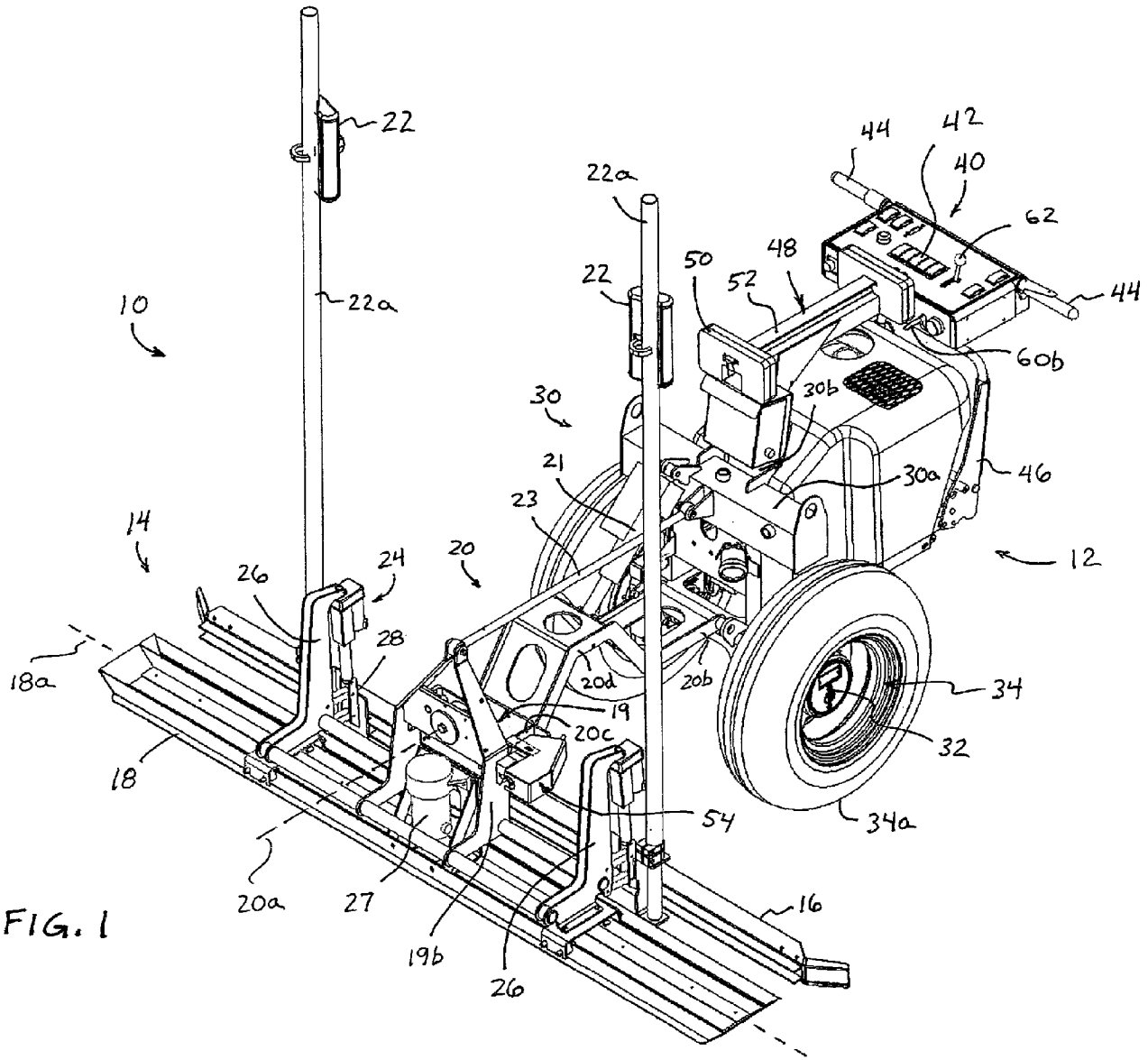
FIG. 1 is an upper perspective view of a screeding device in accordance with the present invention.

Referring now specifically to the drawings and the illustrative embodiments depicted therein, a lightweight wheeled screeding device 10 includes a wheeled support device or assembly or unit 12, which movably supports a screeding head 14, which includes a grade setting device or element, such as a strike-off plow 16, and a vibratory beam or member 18, and which is adjustably mounted to the wheeled support unit 12 via a mounting frame or lift arm or arms 20 (FIGS. 1-7). The lightweight wheeled screeding device 10 is operable by an operator to move over and through or along uncured concrete, while the plow 16 functions to strike off the concrete to the desired grade in front of vibratory member 18 and the vibratory member 18 screeds and smoothes the struck-off concrete surface as the wheeled screeding device 10 is moved along the uncured concrete. The plow 16 is automatically adjustable relative to the vibratory member 18, such as in response to a pair of laser receivers 22 mounted to the plow 16 and a pair of elevation devices or actuators 24 operable to adjust the elevation of the plow 16 relative to the vibratory member 18, while the vibratory member floats or is at least partially supported on the uncured concrete surface, such as in a similar manner as described in U.S. Pat. Nos. 6,976,805; 6,953,304; and 7,121,762, which are hereby incorporated herein by reference in their entireties. Because some of the components and operations of the screeding device may be similar to those of the screeding devices described in U.S. Pat. Nos. 6,976,805; 6,953,304; and 7,121,762, a detailed discussion of those components and operations need not be repeated herein.

Thus, the screeding head 14 is movable over the concrete surface via driving of the wheeled unit 12, with the plow 16 striking off the uncured concrete to the desired level in front of the vibratory member 18, while the vibratory member 18 screeds and smoothes the concrete surface while being at least partially supported by the concrete surface. The screeding head 14 is adjustably mounted to the wheeled unit 12 via the mounting frame or lift arms 20, which may pivot relative to wheeled unit 12 and screeding head 14 to provide for vertical movement or raising/lowering of screeding head 14 relative to the wheeled unit 12. The screeding head 14 may pivot relative to the wheeled unit 12, such as relative to the outer end of the lift arm 20, and about a longitudinal pivot axis 20*a* that extends longitudinally in the direction of travel of the screeding device, as discussed below.

In the illustrated embodiment, lift arm 20 comprises a proximate end or end portion 20*b* that pivotally mounts to the frame of wheeled unit 12 and a distal end or end portion 20*c* that is distal from the wheeled unit and that pivotally mounts to screed head assembly 14, with a bent or curved central portion 20*d* between end portions 20*b* and 20*c*. Curved central portion 20*d* is curved upwardly so as to provide enhanced clearance for operators to manually remove or move the excess poured concrete that may accumulate in front of the plow during operation of the screeding device. Such a curved or raised configuration of the lift arm provides additional clearance over the ground or support surface at or near or in front of the plow to ease removal of the excess concrete, such as via rakes or the like used by operators walking along the screeding pass with the screeding device, and may allow an operator to reach under the lift arm and across the machine to reach and move or remove concrete at the opposite side of the machine from the operator so that excess concrete may be moved or removed by a single operator at one side of the machine.

In the illustrated embodiment, proximate end portion 20*b* of lift arm 20 is pivotally mounted to the frame of wheeled unit 12 and is pivotable about a horizontal pivot axis that extends generally laterally across the screeding device and transverse to the direction of travel of the screeding device. Thus, the lift arm may pivot relative to the wheeled unit to raise and lower the screed head assembly 14, such as via an adjusting element or device 21, as discussed below.

Figure 9A:
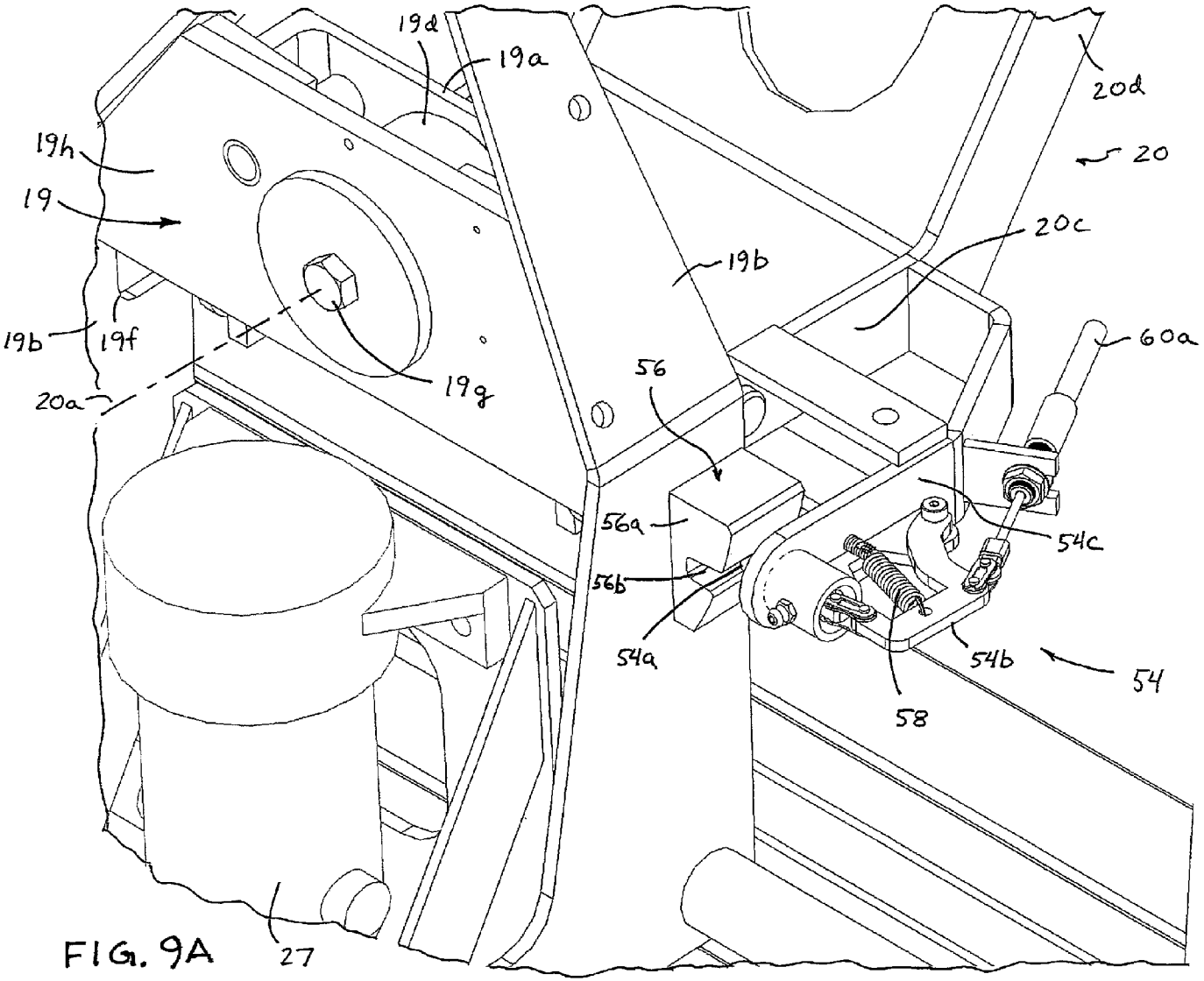
FIG. 9A is a perspective view of a locking mechanism for limiting pivotal movement of the screed head assembly relative to the lift arm in accordance with the present invention.

Similarly, distal end portion 20*c* of lift arm 20 is pivotally attached to screed head assembly 14, such as via a pivot joint 19, such that screed head assembly 14 is pivotable about a horizontal and lateral pivot axis relative to lift arm 20 (so that the angle of attack of the vibrating member may be adjusted, as discussed below). As can be seen with reference to FIGS. 1, 2, 10 and 10A, distal end 20*c* pivotally attaches to a mounting bracket or plate 19*a*, such as via a pivot axle or pin 19*e* connecting or joining the end of the lift arm to the bracket or plate, while the mounting bracket or plate 19*a* pivotally attaches to a mounting bracket or stanchion 19*b* that extends upward from the vibrating member 18 of screed head assembly. In the illustrated embodiment, the mounting plate 19*a* includes a cylindrical bushing element or structure 19*c* (FIGS. 10 and 10A) that is received or partially received at a generally cylindrical collar or receiver 19*d* (FIGS. 2, 9A and 10A) of mounting stanchion 19*b* so as to pivotally mount the screed head assembly to the mounting plate 19*a* (such as via a fastener or bolt 19*g* that extends through a plate or bracket 19*h* of mounting stanchion 19*b* and that may be threadedly attached or received in or at cylindrical bushing element 19*c*). Mounting bracket 19*b* is pivotable relative to mounting plate 19*a* such that the screed head assembly 14 (including the vibrating member 18 and plow 16) is pivotable about a longitudinal pivot axis 20*a* relative to lift arm 20 and wheeled unit 12.

Figure 2:
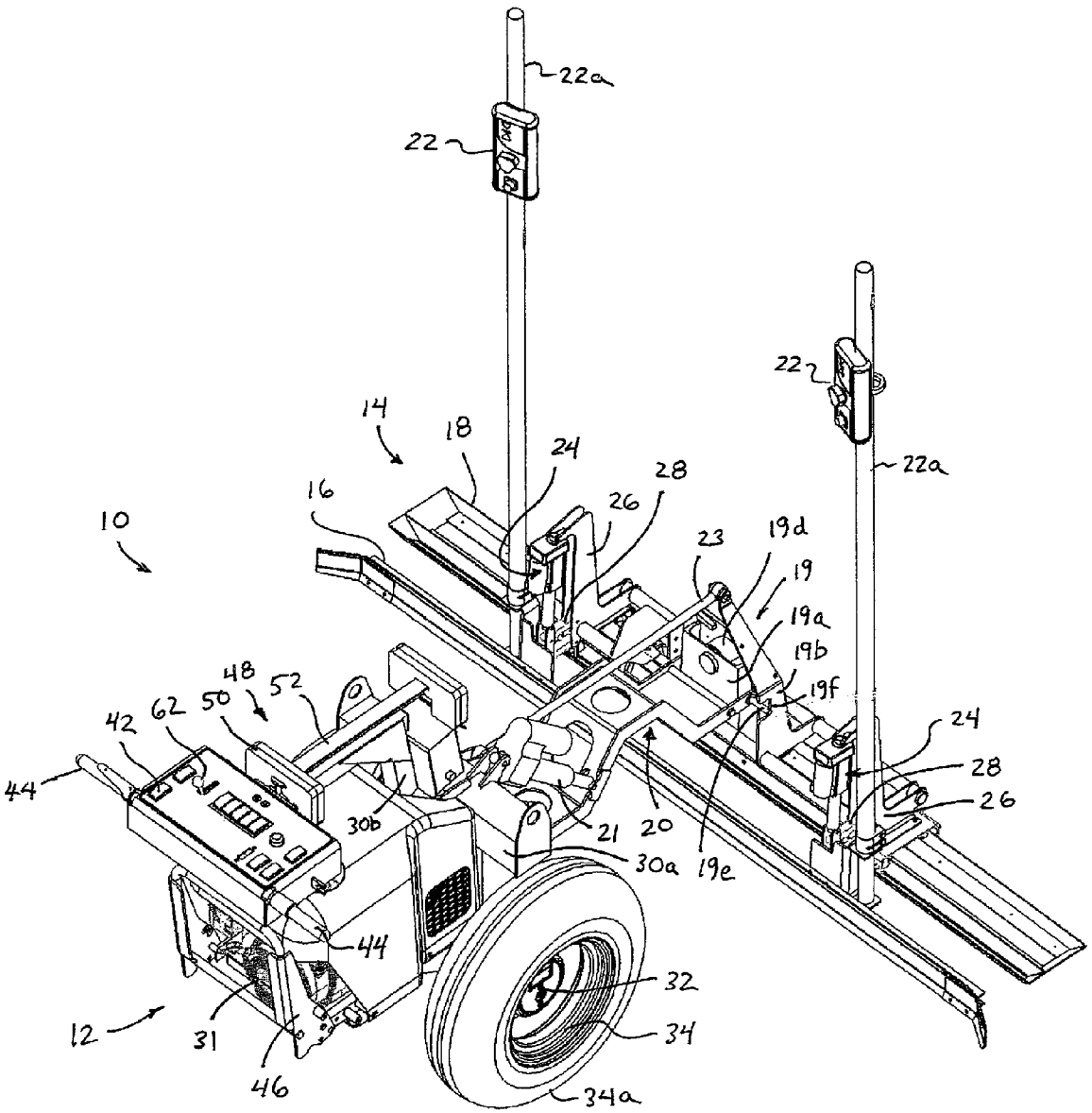
FIG. 2 is another upper perspective view of the screeding device of FIG. 1.
Figure 3:
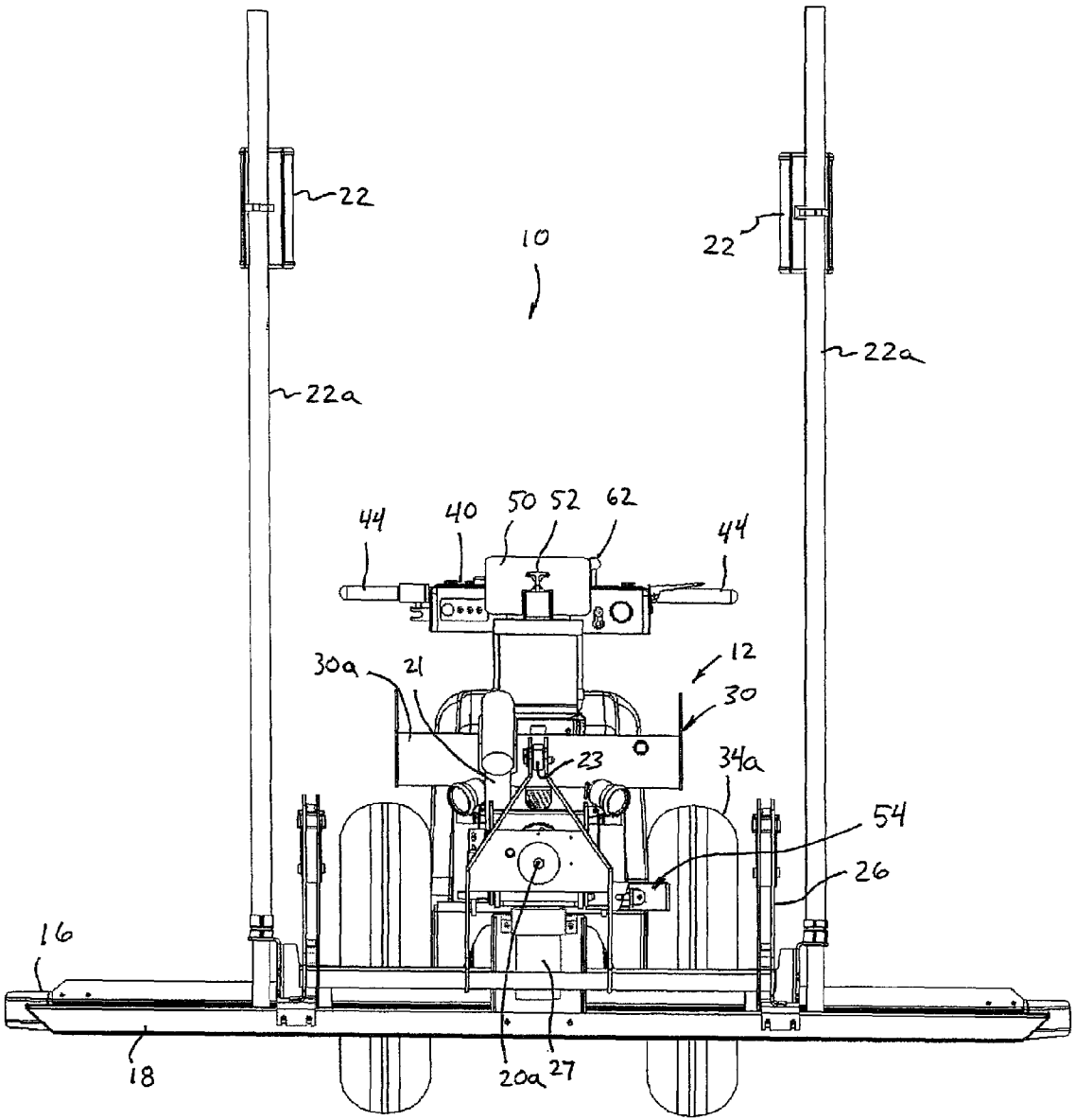
FIG. 3 is a front elevation of the screeding device of FIGS. 1 and 2.
Figure 4:
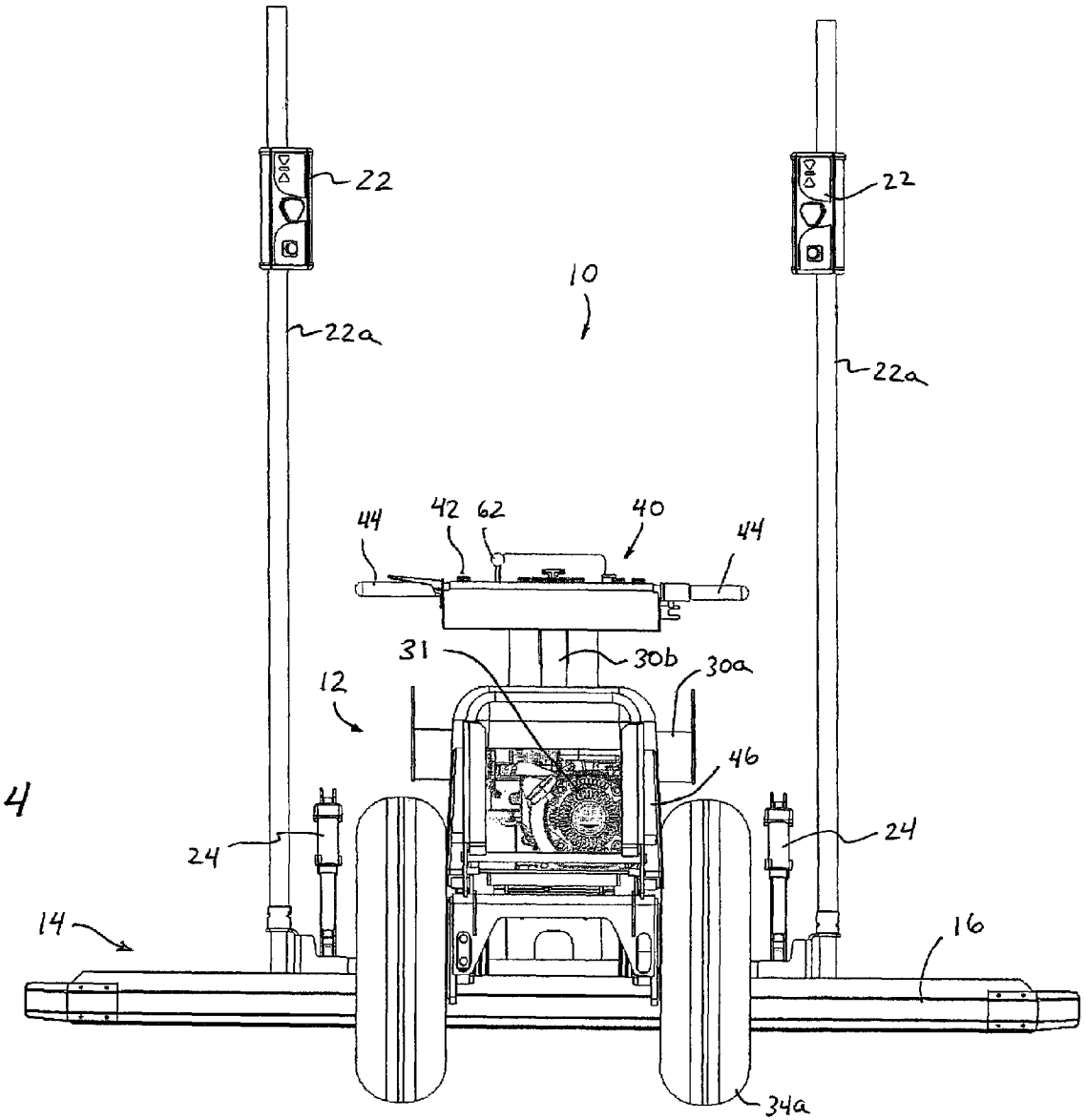
FIG. 4 is a rear elevation of the screeding device of FIGS. 1-3.
Figure 5:
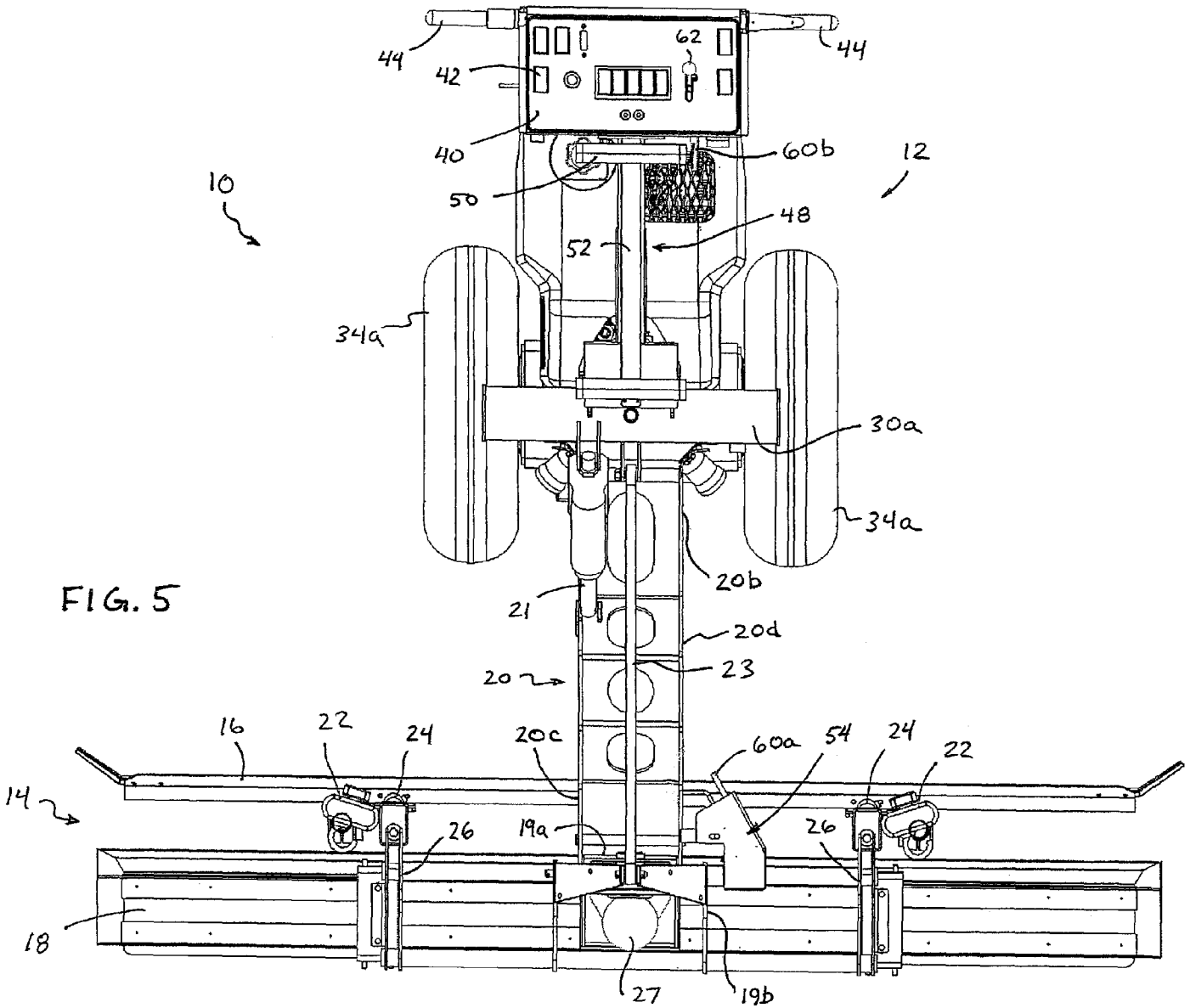
FIG. 5 is a top plan view of the screeding device of FIGS. 1-4.
Figure 6:
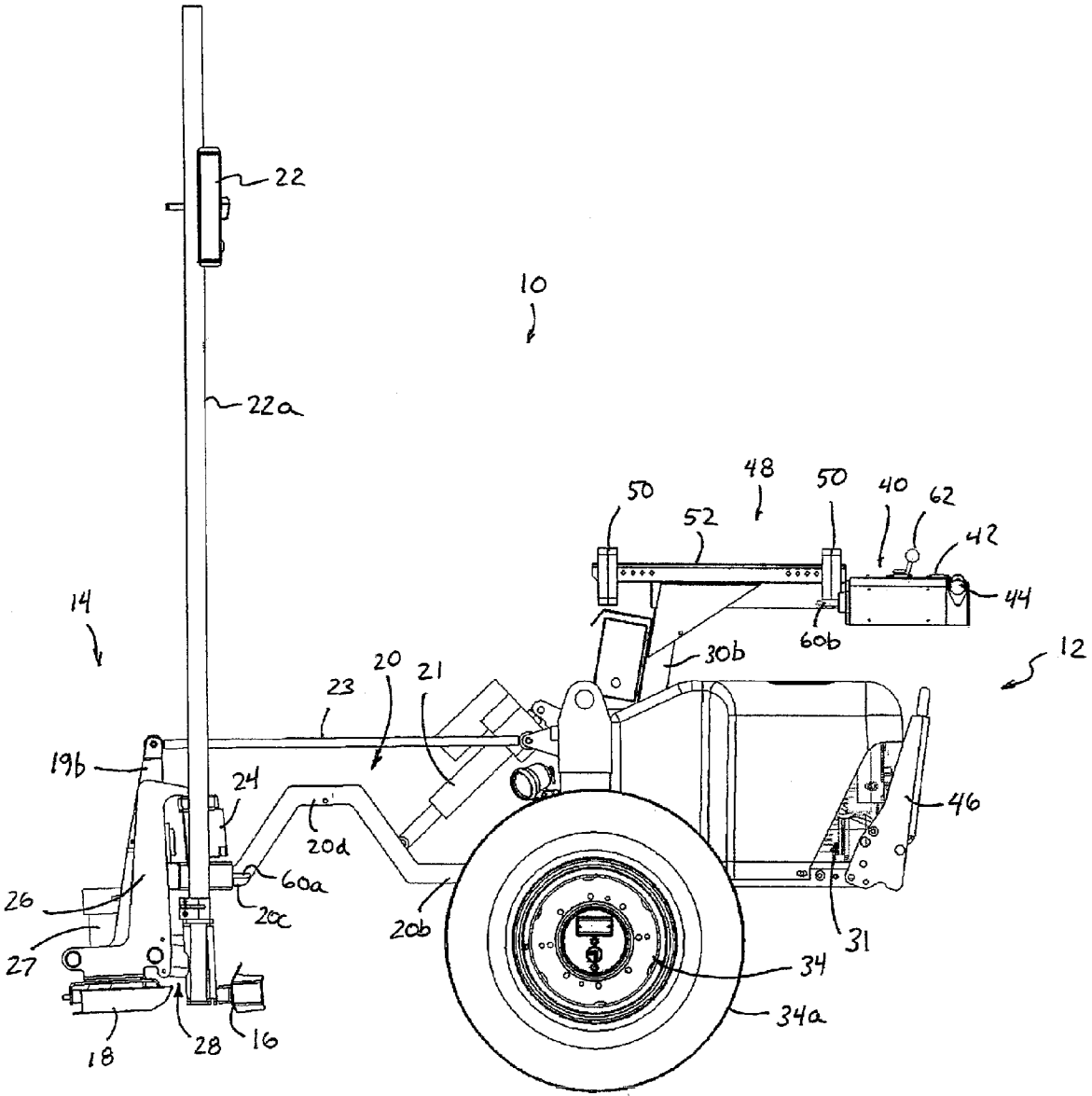
FIG. 6 is a left side elevation of the screeding device of FIGS. 1-5.
Figure 7:
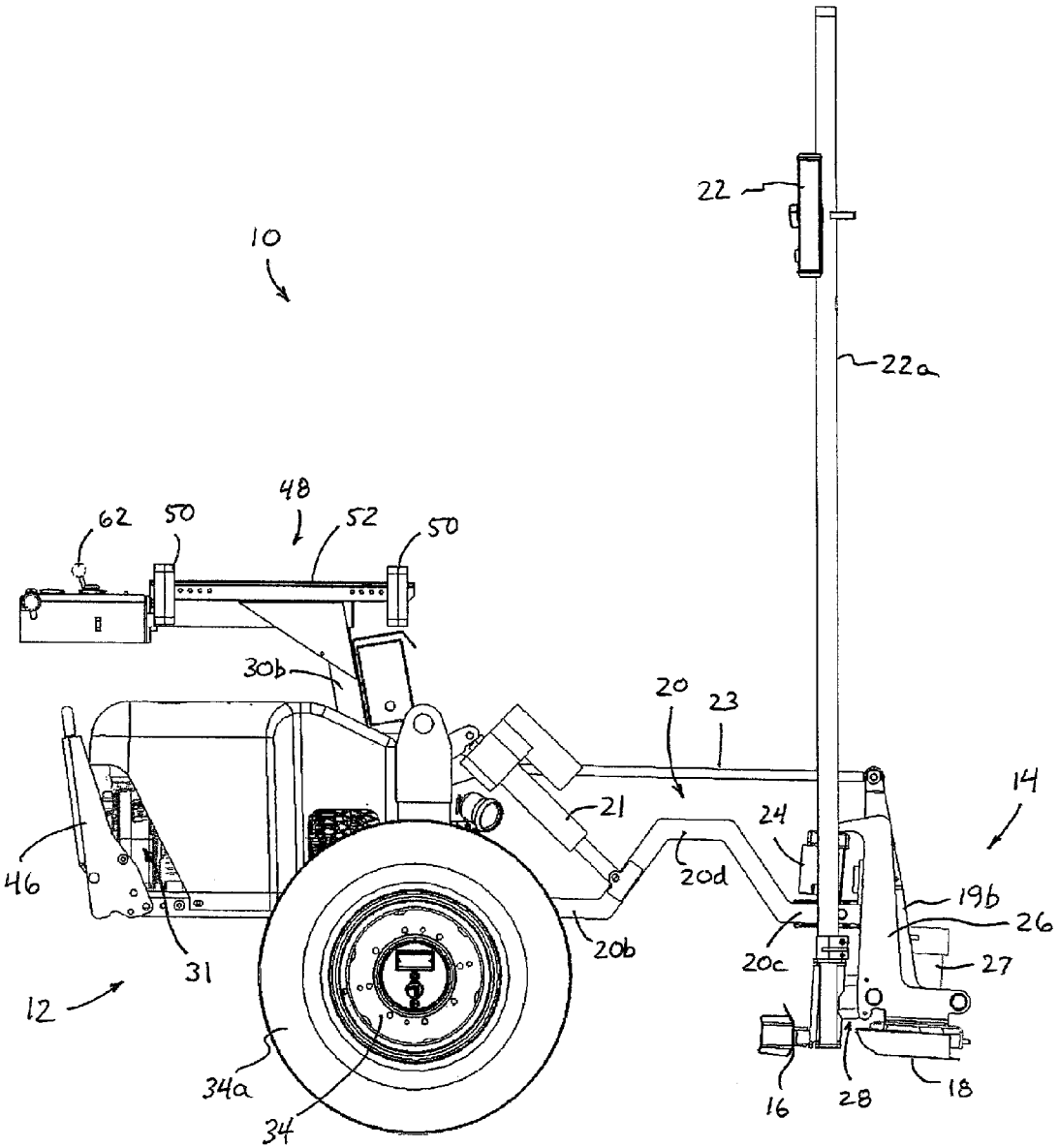
FIG. 7 is a right side elevation of the screeding device of FIGS. 1-6.
Figure 10:
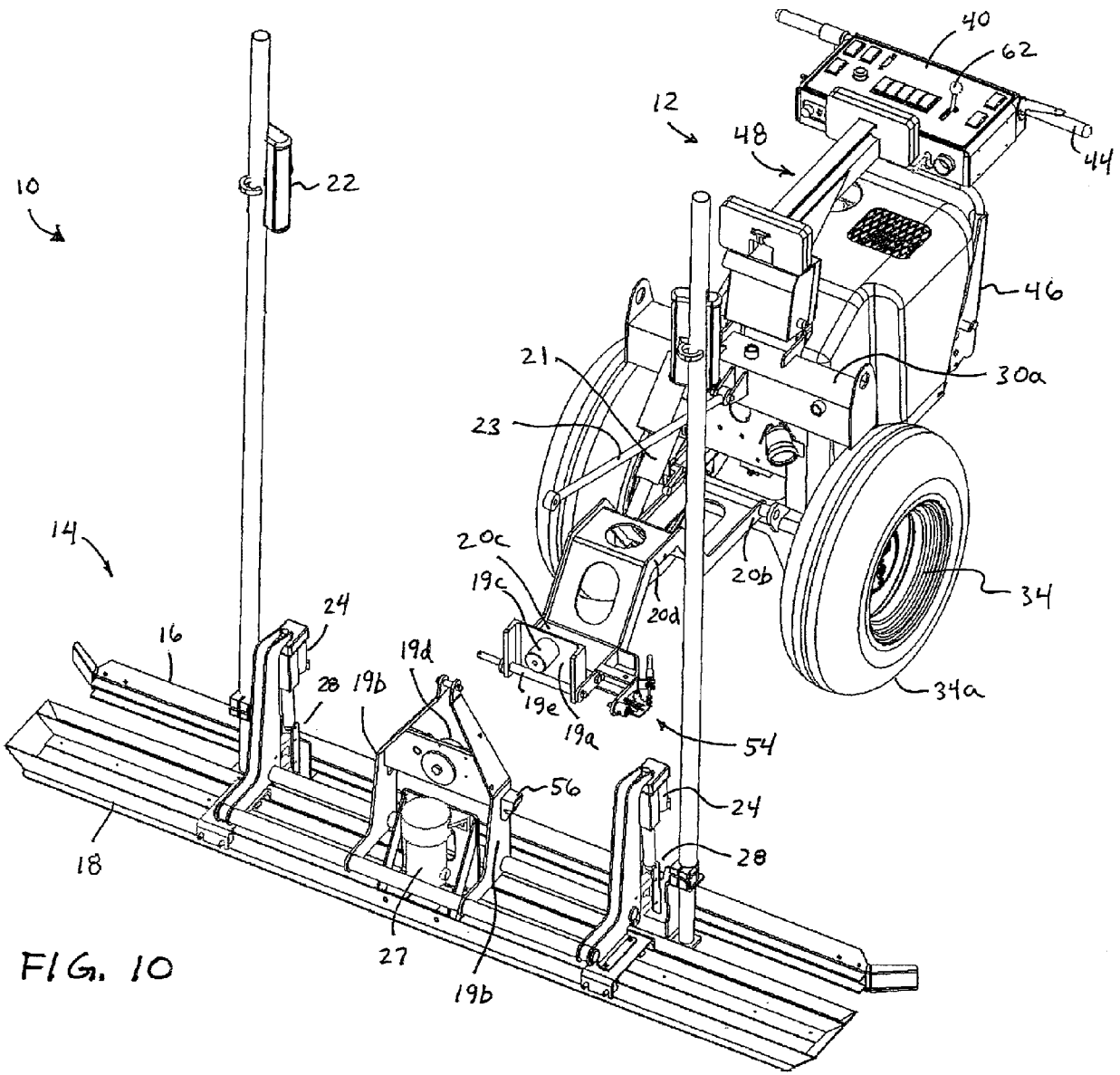
FIG. 10 is a perspective view of the screeding device, showing the screed head assembly detached from the lift arm and the wheeled unit.
Figure 10A:
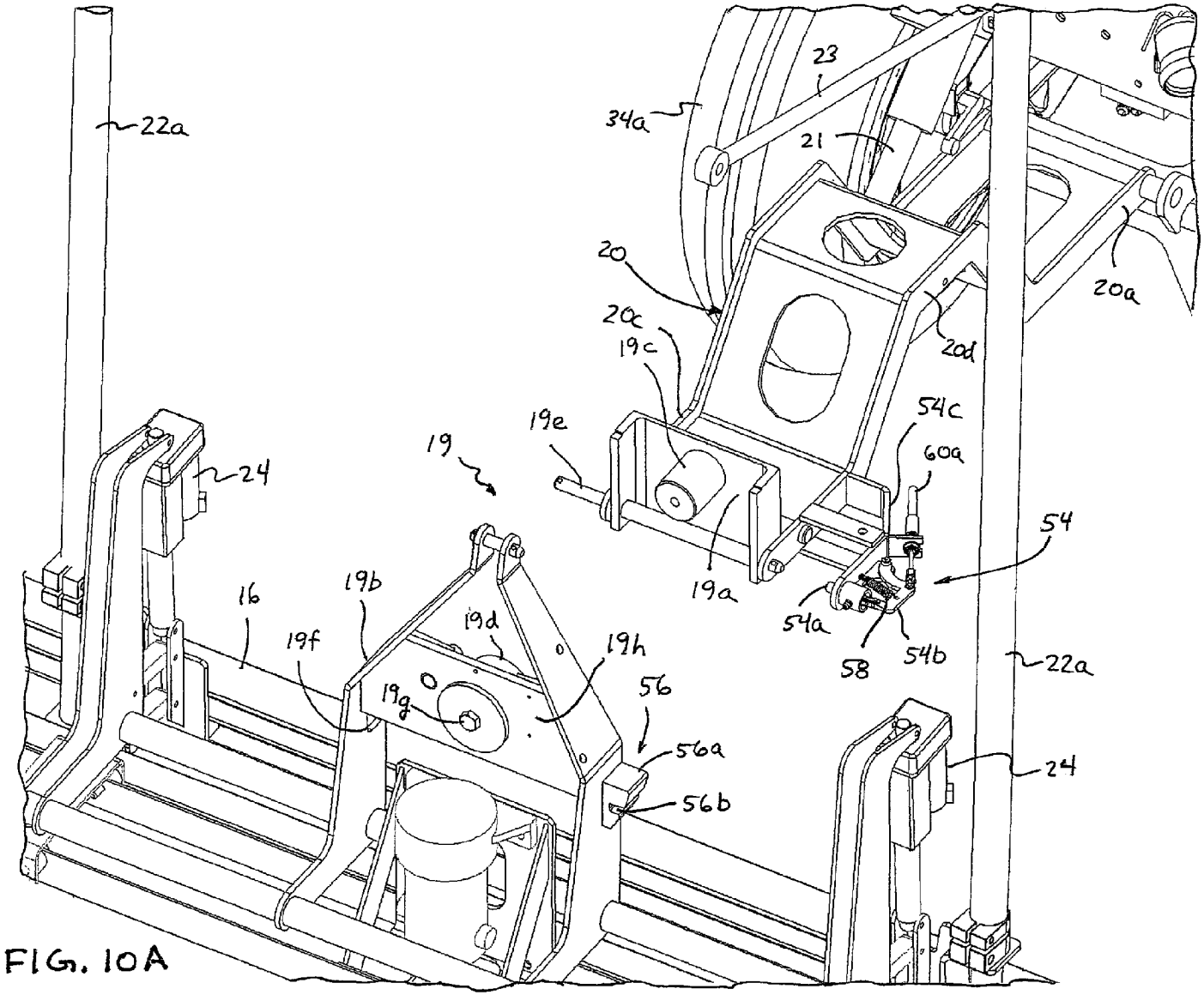
FIG. 10A is an enlarged perspective view of the mounting portions of the lift arm and the detached screed head assembly.
Figure 11:
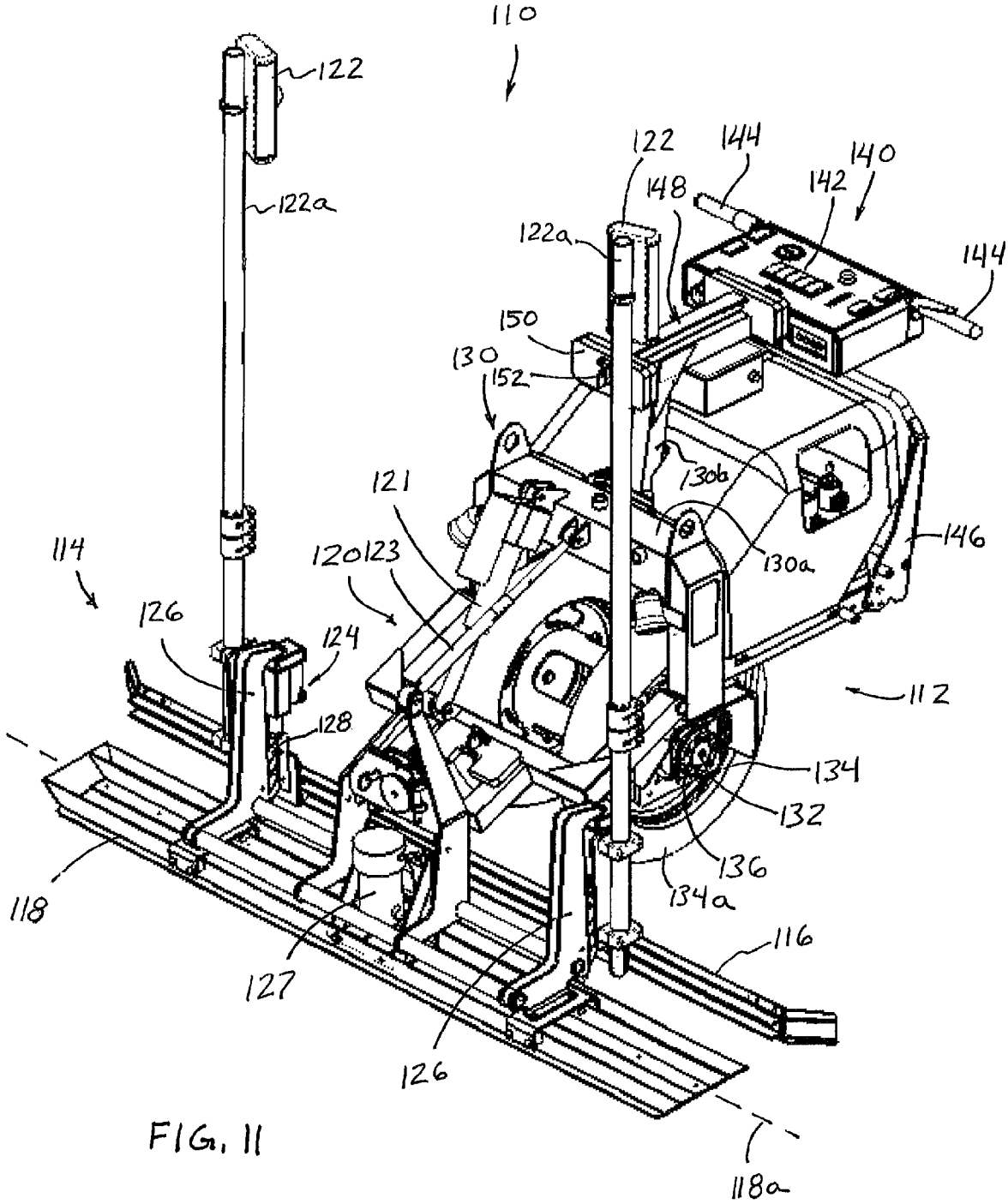
FIG. 11 is an upper front perspective view of a screeding device in accordance with the present invention.
Figure 12:
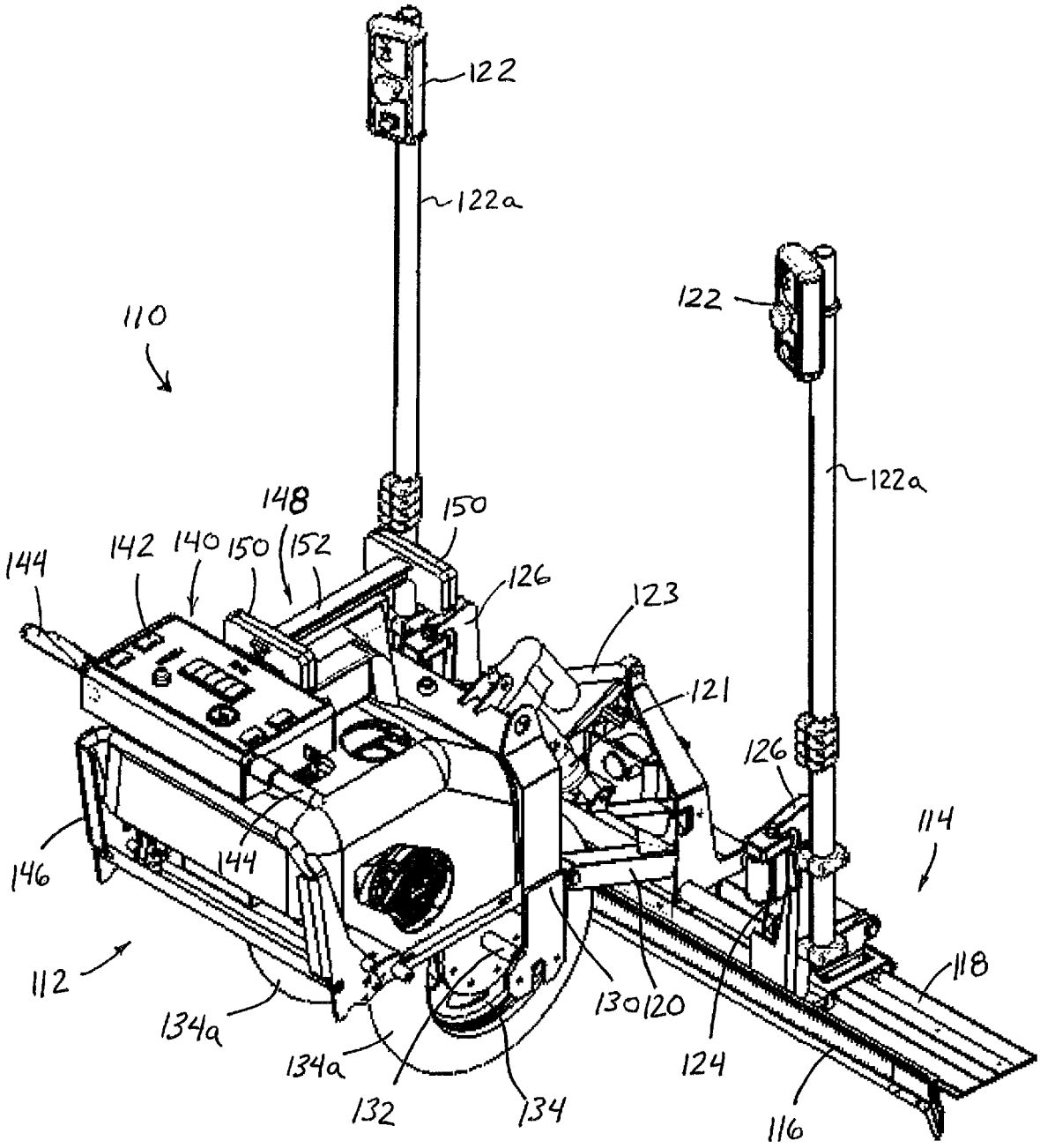
FIG. 12 is an upper rear perspective view of the screeding device of FIG. 11.
Figure 13:
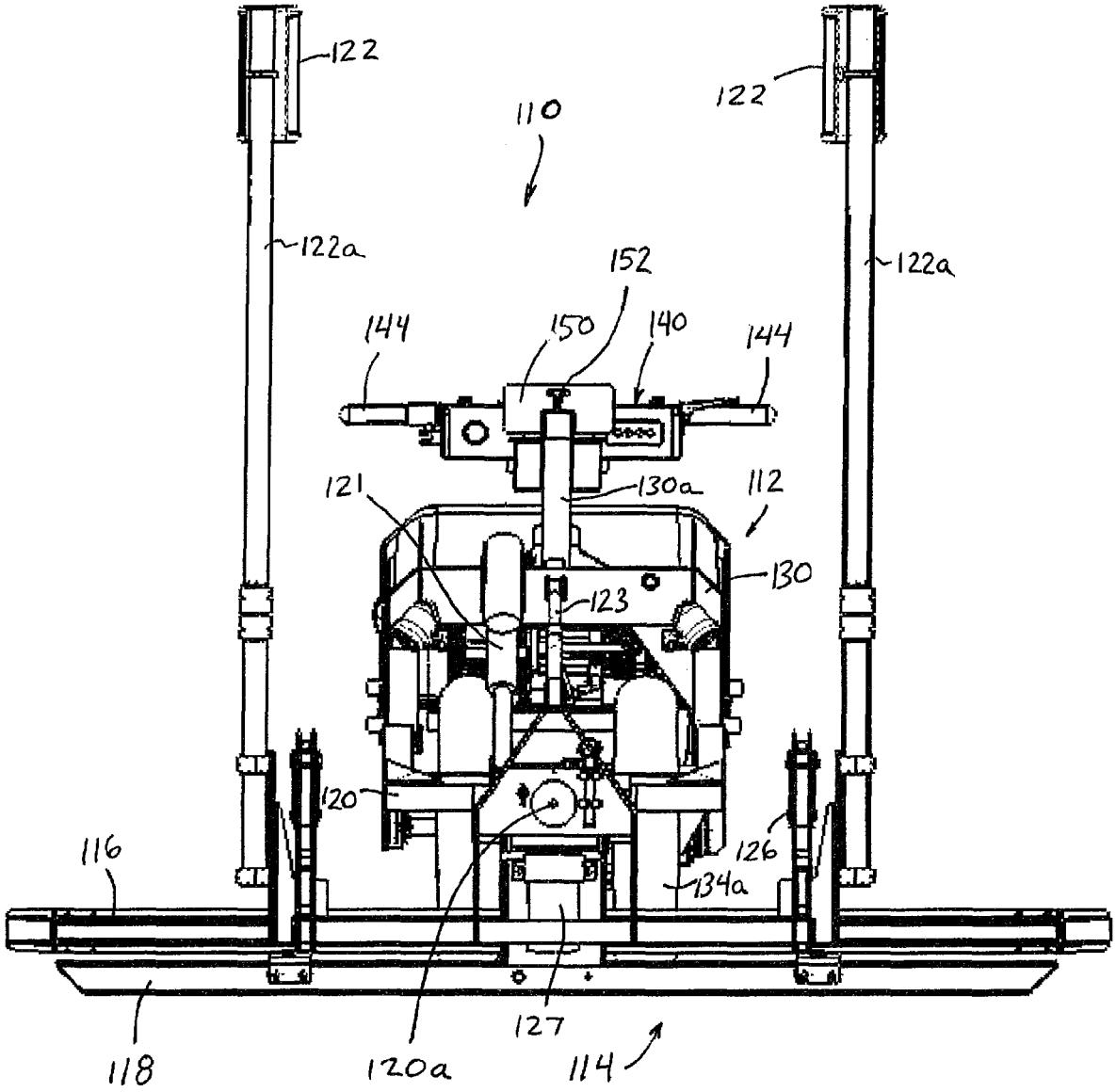
FIG. 13 is a front elevation of the screeding device of FIGS. 11 and 12.
Figure 14:
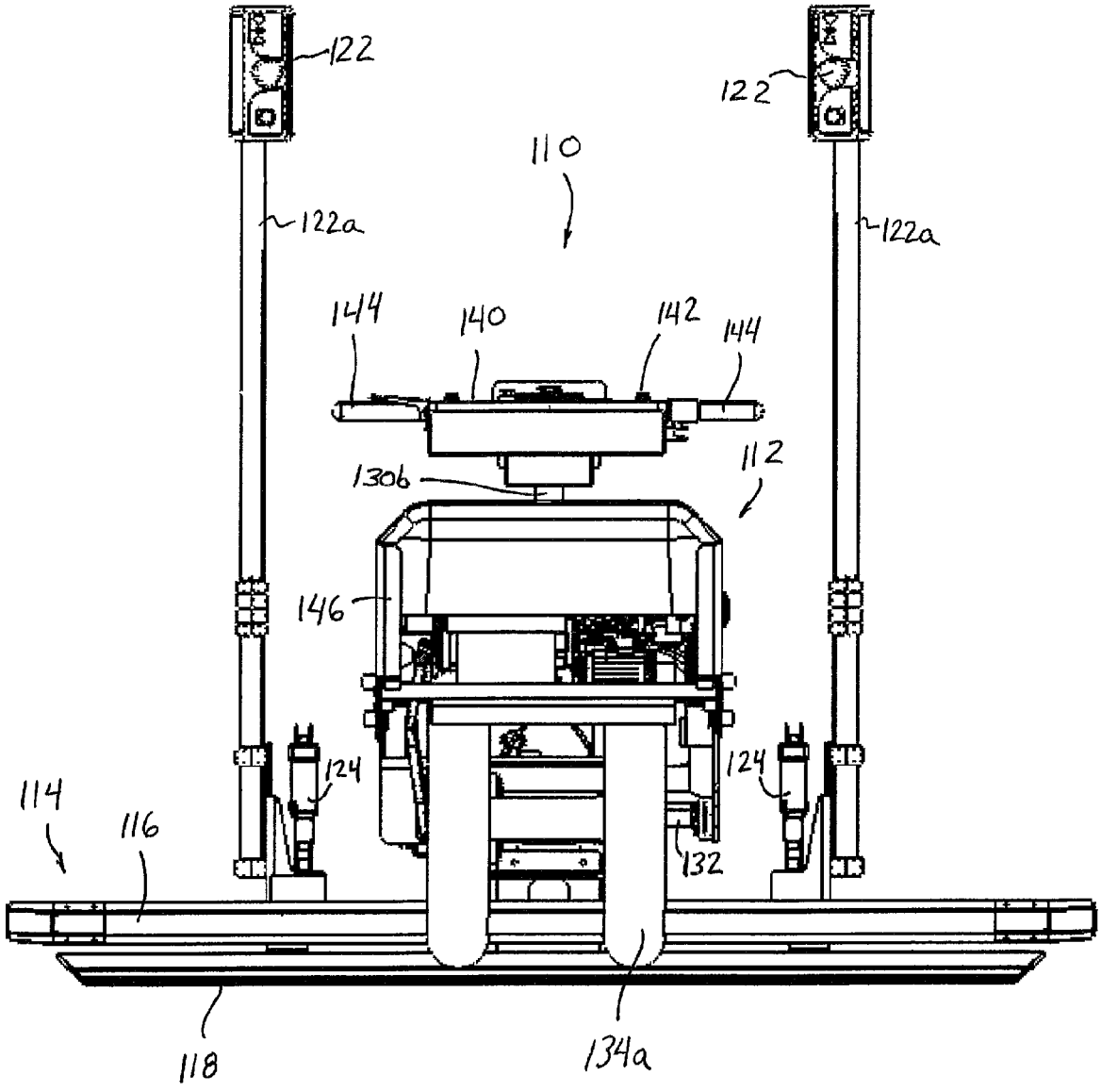
FIG. 14 is a rear elevation of the screeding device of FIGS. 11-13.
Figure 15:
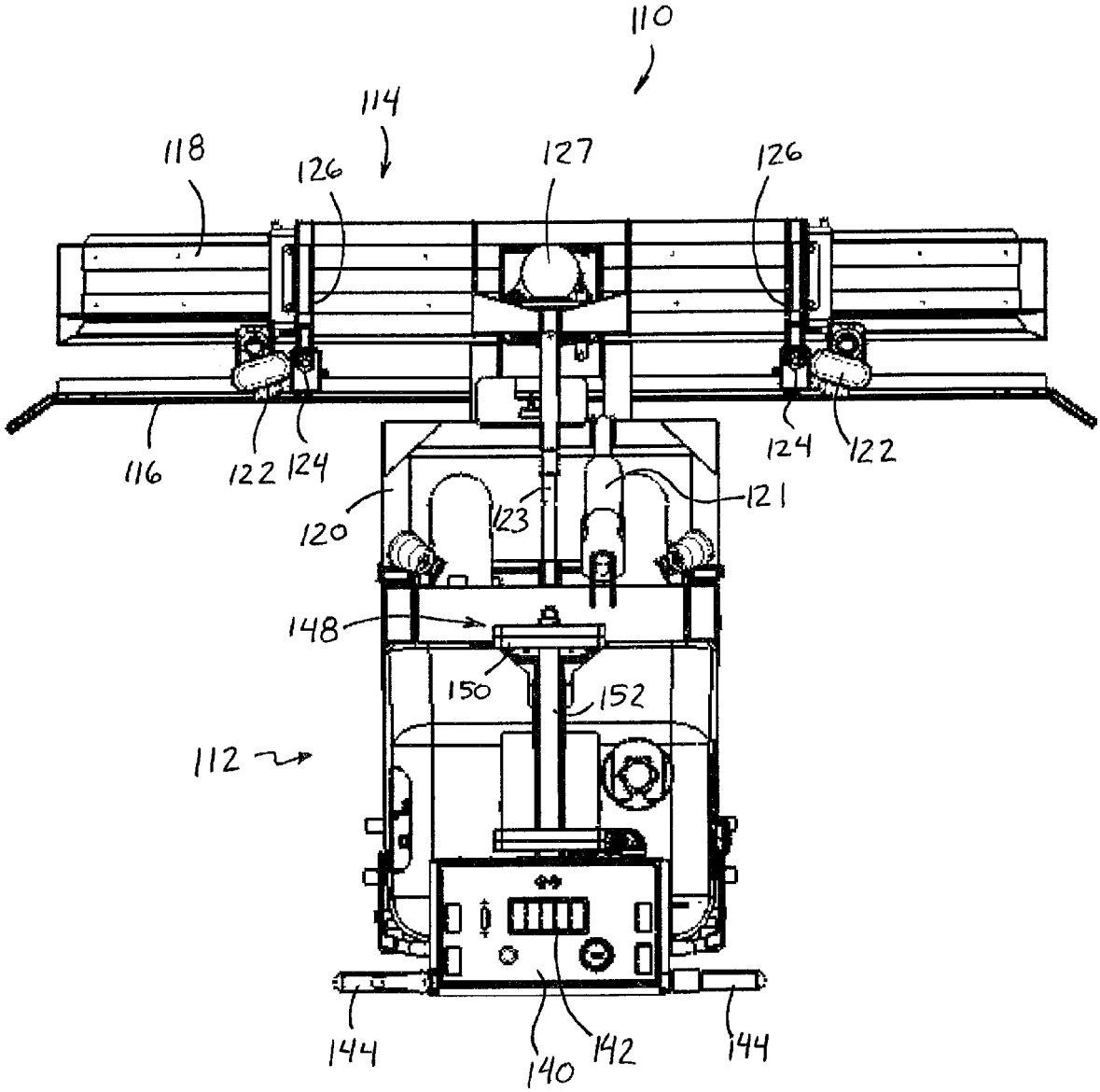
FIG. 15 is a top plan view of the screeding device of FIGS. 11-14.
Figure 16:
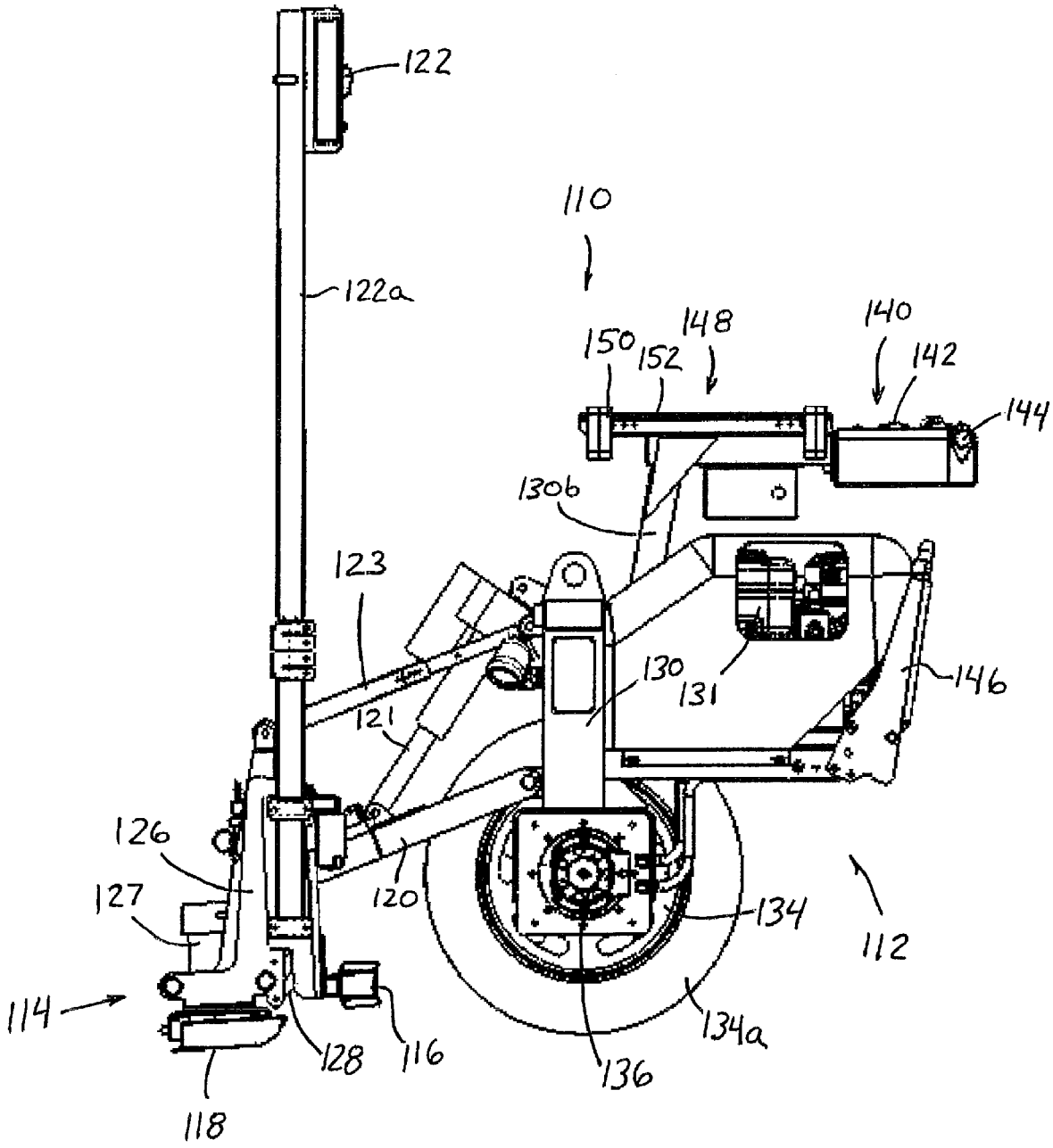
FIG. 16 is a left side elevation of the screeding device of FIGS. 11-15.
Figure 17:
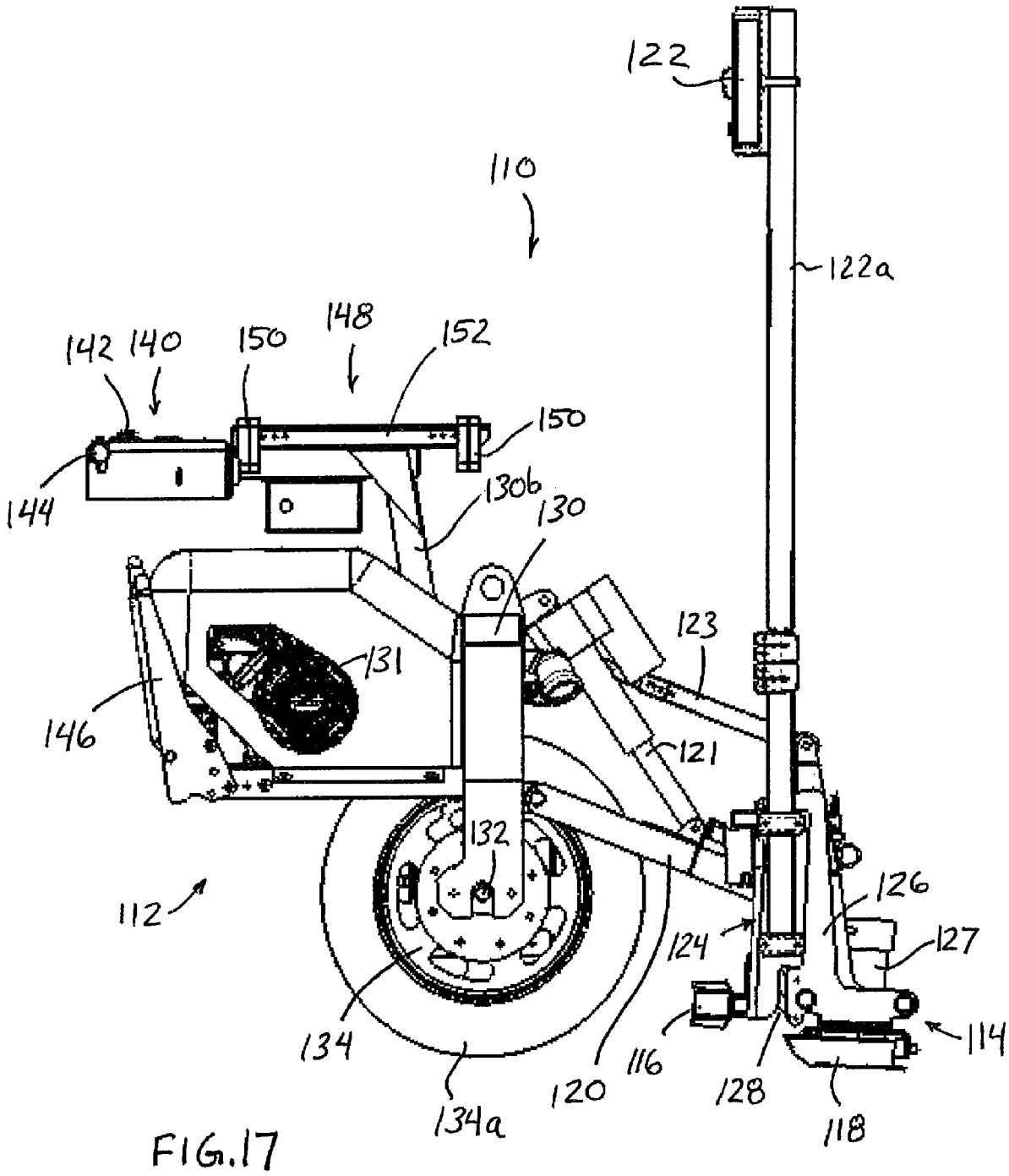
FIG. 17 is a right side elevation of the screeding device of FIGS. 11-16.

Thus, the screed head assembly is pivotally mounted at the outer or distal end of the lift arm and is pivotable about two pivot axes relative to the lift arm and wheeled unit. Optionally, and desirably, pivotal movement of the screed head assembly 14 about the longitudinal pivot axis 20*a* may be limited, such as via one or more stop elements or stops. For example, and as can be seen in FIGS. 2, 10 and 10A, pivot axle or pin 19*e* may extend laterally at one side of mounting plate 19*a* and may be received in a notch or opening 19*f* in mounting bracket 19*b*, whereby pin 19*e* limits pivotal movement of the screed head assembly 14 in either direction by engaging the upper and lower walls of the notch 19*f*. Optionally, pivotal movement of the screed head assembly 14 may be selectively limited or substantially precluded via selective locking of the screed head assembly relative to the mounting plate and/or lift arm, such as by an operator of the screeding machine, as discussed below.

Screeding head 14 may be adjusted to a desired or appropriate level and/or angle relative to wheeled unit 12, such as via adjusting element or device 21, such as a hydraulic cylinder or linear actuator or the like, which is adjustable in length to adjust the angle of the mounting frame or lift arms 20 relative to the wheeled unit 12 and thus to adjust the elevation of the screeding head relative to the wheeled unit and relative to the support surface at which the screeding machine is positioned. The adjusting device 21 may comprise an electric linear actuator to reduce the hydraulic system functions of the machine to reduce the overall weight of the screeding machine, but could be a hydraulic actuator or cylinder or other suitable extension/retraction element or device while remaining within the spirit and scope of the present invention. In the illustrated embodiment, adjusting element 21 is mounted at one end to a frame portion 30*a* of the frame 30 of wheeled unit 12 and at the other end to lift arm 20, such as toward or at the central portion 20*d* of lift arm 20, whereby extension and retraction of adjusting element 21 causes lift arm 20 to pivot relative to the frame of wheeled unit 12 to lower and raise the screed head assembly 14 relative to the wheeled unit and the support surface and placed concrete thereat.

Screeding device or machine 10 also includes an adjusting element 23 connected between the wheeled unit 12 and the screeding head 14. In the illustrated embodiment, the adjusting element 23 is connected at one end to frame portion 30*a* and at the other end to an upper portion of mounting bracket or stanchion 19*b* of screed head assembly 14. Adjustment of the length of adjusting element 23 causes screeding head 14 and mounting plate 19*a* to pivot relative to lift arms 20 and about a generally horizontal pivot axis extending laterally across the machine to adjust a pitch or "angle of attack" of the screeding head relative to the support surface. Accordingly, the pitch angle of the vibratory member relative to the wheeled support and concrete surface may be selected and adjusted via adjustment of the adjustable member 23 and/or extension and/or retraction of the adjustable element or device 21. Once a desired pitch or angle is set via adjustment of adjustable member 23, the grade or elevation height of the vibrating beam may be adjusted via the adjustable device or actuator 21, while the pitch angle or "angle of attack" of the vibrating beam remains at the desired setting. The vibratory member 18 and plow 16 may be lifted or raised above the uncured concrete surface or any low obstacles to ease movement of the screeding device 10 through a work site area to and/or from a desired location or area of the uncured concrete.

The pitch angle and operating range of the elevation height of the screeding head 14 are selected to provide optimal results based upon the site conditions, concrete slab thickness, and concrete mix design, to achieve the desired consolidation, leveling, and flattening and/or to affect the smoothing of the uncured concrete surface to fill in and smooth over the tracks left in the uncured and unscreeded concrete by the operator and the wheels of the wheeled support unit 12 in front of the plow 16 and vibratory member 18 as the screeding device 10 is moved or driven over and through the uncured concrete surface.

Similar to the screeding machines described in U.S. Pat. Nos. 6,976,805; 6,953,304; and 7,121,762, plow 16 of screeding machine 10 is attached to spaced apart frames or brackets or support members 26 by respective sets of linkages 28, while the frames 26 are mounted to and extend generally vertically upward from the vibratory member 18. The plow 16 is vertically adjustable relative to the frames 26 and the vibratory member 18 by a pair of elevation devices or actuators 24, such as electric linear actuators or the like. Plow 16 includes a plow blade or edge along a generally rigid structural member or metal extrusion, whereby the edge engages the uncured and unscreeded concrete and strikes the concrete off in front of the vibratory member 18 and to the desired or appropriate level as the screeding device is moved over and through the uncured concrete.

Vibratory beam or member 18 is a generally flat member extending laterally outwardly in opposite directions from the pair of frames or frame members 26. Vibratory member 18 may comprise any suitable vibratable member and preferably has a generally planar, flat and smooth lower surface for engaging and working the uncured concrete surface. The length and width of vibratory member or beam 18 may be selected to provide a large enough footprint of the lower surface of the beam such that vibratory member 18 floats on or is at least partially supported on the uncured concrete surface. Although shown and described as having a vibrating beam, the screeding device and/or screed head may alternately include any other type of concrete surface working device or member, such as a roller, a flat or contoured plate or the like, which engages and works the uncured concrete surface to flatten and/or smooth the concrete surface as the screeding device is moved over and along the uncured concrete.

Plow 16 is adjustable relative to vibratory member 18 via pivotal movement of linkages 28 and in response to actuators 24, such as in a similar manner as described in U.S. Pat. Nos. 6,976,805; 6,953,304; and 7,121,762. The actuators 24 may be powered via any suitable electrical power source, such as a 12-volt DC electrical power source, such as an alternator including an AC to DC power converter and a voltage regulator or the like. It is preferred that the actuators 24 comprise electrically powered linear actuators to reduce the hydraulic powered content of the screeding device to reduce the weight of the screeding device and to reduce or eliminate hydraulic connections between the wheeled unit and the screeding head, in order to ease disconnection of the screeding head from the wheeled unit, as discussed below. However, it is envisioned that the linear actuators may comprise hydraulic cylinders or any other suitable means for imparting generally vertical movement of the plow relative to the vibratory member, while remaining within the spirit and scope of the present invention.

The elevation of the plow 16 is adjustable relative to the vibratory beam 18, preferably in response to a laser plane system. Optionally, and preferably, a control circuit or system for controlling the actuators 24 receives input signals from each of a pair of laser receivers 22, which each sense the elevation of a fixed laser plane reference that has been established over the job site by a separate rotating, laser plane generator or projector, as is commonly known in the industry. Each laser receiver 22 is mounted to a support rod or mast 22*a* which is in turn mounted to the grade setting device or strike-off plow 16. The laser receivers may be adjustably mounted to masts 22*a* or the masts may be telescoping masts to facilitate vertical adjustment of the laser receivers relative to the grade setting device or plow. The masts 22*a* and laser receivers 22 of the laser plane system may be positioned toward laterally outward ends of the plow or may be positioned at or near the frames 26, where they are generally aligned with or in-line with the actuators 24, in order to accommodate the relative response of the laser-controlled elevation actuators and control system.

Vibration of vibratory member 18 is accomplished by a powered vibrator assembly or device 27 powered or driven by a power source of the screeding device, such as a gasoline powered drive motor or engine, or a battery powered drive motor, or the like. The vibrator assembly may include a vibration actuator that has a self-contained electric motor for driving at least one eccentric weight at the vibratory member. The eccentric weight may include two spinning eccentric masses that can be clocked or indexed relative to one another at a plurality of positions within a fixed range of adjustment (and may be finely or infinitely adjusted to an infinite number of positions within the fixed range of adjustment). This range of adjustment provides more or less total vibrational energy to the vibratory beam. To provide for adjustment of the indexing of the eccentric masses or weights, access to the eccentric weights adjustment element or adjuster may be provided by removing a cover at the vibration actuator, such as, for example, by loosening and/or removing threaded screws that secure the cover at the top of the vibration actuator. The vibrator actuator may comprise any suitable vibrator actuator, such as, for example, a vibrator actuator of the type available from Vibco, Inc., of Wyoming, R.I., whereby the motor is a permanent-magnet, 12-volt DC, low-amp unit offering reduced current-draw requirements while maintaining sufficient vibration output, and while providing sufficient vibration with reduced size and weight for this smaller and more compact machine. The implementation of such a vibrator actuator may eliminate a potential hydraulic system function requirement for this machine design, thereby reducing the weight of the screeding device or machine.

Because the actuators 24 and the vibratory device of the vibratory member may be electrically operable devices, the screeding device 10 may not include any hydraulic connections between the screeding head 14 and the wheeled unit 12. Thus, the screeding head 14 may be more readily and quickly detached from the machine's mounting frame or lift arms 20, such as for ready transport of the machine in a pick-up truck cargo bed or the like. For example, the screeding head may be removed from the wheeled unit via the removal of two hitch-style pins (such as pins that are received through corresponding or aligned apertures or holes at the screeding head and the lift arms and that are retained in the holes via a cotter pin or clip element or other retaining element to limit or substantially preclude unintentional dislodgement of the pins from the holes) at the outer end of the mounting frame or lift arm, and disconnection of the two laser receivers and the electric vibrator motor at the respective electrical connection sockets. Such a quick disconnect feature allows for the quick detachment of the screed head assembly from the wheeled unit for quick disassembly of and easier transport of the screeding machine.

The wheeled unit 12 of screeding machine 10 includes a frame 30 that supports the power source or engine 31 and that is mounted to an axle 32, at which a pair of wheels 34 are rotatably mounted. In the illustrated embodiment, the axle 32 supports a pair of spaced apart wheels 34, with the wheels being arranged at or outboard of the lateral sides or outer frame members of frame 30 and being driven via a drive motor, such as a hydraulic drive motor or other suitable rotational drive motor. The drive motor may be located at one or both of the wheels or at the axle and is operable to rotatably drive the wheel axle or both wheels about the axis of the wheel axle. In the illustrated embodiment, each wheel 34 includes a respective pneumatic tire 34*a* (such as, for example, 90/100×14 inch off road motorcycle tires or 25×8×12 inch ATV tires or any other suitable tires) mounted onto the wheel hub structure.

The power source 31 may comprise an internal combustion engine, such as a 6 hp gasoline powered engine (such as, for example, a 6 hp Robin 4-stroke, air cooled engine or other suitable engine or power source). Preferably, a small, lightweight engine is provided to reduce the overall weight of the screeding device. Optionally, the power source may include an electric drive motor, such as a battery powered motor or the like, while remaining within the spirit and scope of the present invention.

Screeding machine 10 may also include a closed loop hydraulic system for operating one or more hydraulic devices of the machine, such as a hydraulic drive motor for rotatably driving the wheels of screeding machine 10. Such a hydraulic system may include a hydraulic reservoir 30*a* or tank and pump for pumping the hydraulic fluid from the reservoir to and through the drive motor. Optionally, and desirably, the hydraulic reservoir may be incorporated into a leak-proof structural tube member 30*a* of the frame support portion 30 of the machine that may limit or substantially eliminate a separate hydraulic reservoir or tank component as well as a separate hydraulic fluid cooler. In such a structural tube configuration, any excess heat in the hydraulic system fluid may be readily dissipated through the walls of the structural tube member, while efficient heat transfer may be provided by use of aluminum (or other suitable material) for the structural tube member and for the frame support portion of the machine, since aluminum is an excellent conductor of heat and is often used in various other industrial cooling applications.

In the illustrated embodiment, the wheels are driven via at least one hydraulic motor powered by the engine, with the other devices and actuators and the like of the machine being electrically powered, in order to reduce the hydraulic connections to the screed head assembly and to reduce the overall weight of the screeding machine. However, it is envisioned that each motor and/or actuator of the machine may be otherwise powered or controlled, while remaining within the spirit and scope of the present invention.

Optionally, and desirably, several of the components of screeding machine 10 lend themselves to being fabricated from extruded aluminum or magnesium to reduce the overall weight of the screeding machine. For example, the wheeled unit frame members and/or the vibrating member and/or the plow can be manufactured from extruded aluminum or magnesium to provide enhanced strength, while providing a light weight machine with a reduction in the number of individual components of the machine.

The propulsion system or drive wheels of screeding machine 10 may include a self-contained hydrostatic transaxle drive unit (transmission), such as a unit of the types available from Eaton/Char-Lynn Hydraulics of Eden Prairie, Minn. Such a transaxle drive unit may utilize a simple rotary mechanical drive input from the engine and operator control inputs (such as from a control panel 40), which may include a drive speed selection or input and a travel direction selection or input. Use of such a hydrostatic transaxle provides the ability to drive the wheels at different speeds to facilitate turning and maneuvering of the screeding machine, and may eliminate a potential hydraulic system function (e.g. two hydraulic drive motors for the wheels) requirement for screeding machine 10. Optionally, the propulsion system may comprise a system having one wheel drive motor for driving both wheels through a common hub, or may comprise a system having two drive motors for driving each respective wheel separately, such as in a similar manner as described in U.S. Pat. Nos. 6,976,805; 6,953,304; and 7,121,762. The single drive motor and transaxle configuration described above may be desirable for screeding machine 10, because such a configuration may further reduce the complexity, cost, and weight of the screeding machine.

Screeding machine 10 includes a control panel 40 at the end of the wheeled unit 12 opposite from screeding head 14. Control panel 40 provides user actuatable inputs 42, such as switches and/or buttons and/or the like, for an operator to actuate to control or adjust various functions of the screeding machine during operation of the screeding machine. In the illustrated embodiment, control-panel includes a pair of handle bars or handgrips 44 for the user or operator to grasp while controlling and operating the screeding machine.

For example, the control panel 40 may provide a speed control input, such as at one of the handgrips 44 of the machine, for adjusting the speed of the engine and/or wheel drive motor to adjust the rate of travel of the screeding machine. For example, the rotating portion of the handgrip may include a short lever-arm that extends radially outward from the center axis of rotation of the rotating portion of the handgrip. The outer end of the lever-arm may include a small mechanical rod end with a small spherical steel ball and socket arrangement and with a semi-flexible control cable threaded to and connected to the rod end. The semi-flexible control cable may include an outer housing and a twisted steel wire inner cable, whereby the control cable may transfer both pushing and pulling forces through the semi-flexible cable assembly. Push-pull control cables of this type are commonly available in the industry. Thus, when the operator turns or twists or rotates the rotating portion of the handgrip either forward of backward, the rotary motion of the hand grip is transferred into a push-pull action at the far end of the semi-flexible control cable assembly. The mechanical push-pull action at the end of the cable assembly is utilized to directly actuate the swash-plate of the hydraulic system pump through a reversing linkage or lever mechanism or the like. The hydraulic pump may typically be driven at a constant speed by the internal combustion engine, while the variable output flow of the hydraulic pump may be used to drive the wheel drive motor to propel the machine at the desired speed. Thus, the rotating portion of the operator's hand grip serves to control the speed of the machine's wheel drive or propulsion system.

Optionally, other propulsion control means (such as, for example, a system whereby rotation of a portion of the handgrip may vary the propulsion flow-control or needle valve) may be implemented while remaining within the spirit and scope of the present invention. The rotation of the shaft on the flow control varies the available flow of hydraulic oil delivered to the wheel drive hydraulic motors, while the internal combustion engine drives the hydraulic pump at a near constant speed and oil flow output. The transfer of mechanical rotation from the hand grip to the flow-control valve may be accomplished mechanically by a pair of miniature sprockets and a small continuous loop of roller chain.

Optionally, screeding device or machine 10 may also include a kickstand or adjustable support 46 at the rearward end of the wheeled support 12 to provide support of the rearward end of the wheeled support when the screeding device is not in use or while the machine is being generally transported on a flatbed truck or trailer between screeding sites. For example, the kickstand 46 may be movable or adjustable or pivotable between a raised position (as shown in FIGS. 1, 2, 4, 6 and 7), where the screeding device may be moved and operated as discussed below, and a lowered position. When in the lowered position, the kickstand engages the support surface to support the free end of the wheeled unit to limit or substantially preclude tipping of the machine backward when it is parked, being generally transported, or not in use and when an operator is not holding the handgrips of the screeding machine. Such tipping may otherwise occur if the rear portion or handlebars or handgrips 44 of the screeding device are pushed downward, due to the finely balanced characteristics of the machine about the wheels. Additionally, the kickstand 46 serves as a support member for the rearward end of the wheeled support whenever the screed head assembly 14 is detached from the machine, since the normal stability and balance of the machine relies substantially on the weight and moment arm of the screed head 14 at the front of the machine.

Optionally, and desirably, screeding machine 10 may include a weight or balance adjustment system 48, which is quickly and readily adjustable to finely adjust the balance characteristics of the machine about the wheel axle 32, which in turn quickly and accurately adjusts a down pressure of the vibratory member at the concrete surface. In the illustrated embodiment, balance adjustment system 48 includes a plurality of weighted plates or elements or counterweights 50 that are slidably or movably located along an elongated support or track or rail element 52, such as a track or rail disposed along an upper region of the wheeled unit 12 (such as at an upwardly extending frame portion or member 30*b* of frame portion 30 of wheeled unit 12) and at or near the control panel 40. The track or rail element 52 extends longitudinally along the wheeled unit and in the direction of travel of the machine and extends over the wheel axle 32 and in both directions from a location generally above the wheel axle. Thus, movement of the counterweights 50 along the track or rail element 52 adjusts the weight or balance of the machine at either side of the wheel axle 32, and thus adjusts the weight or down pressure of the vibratory member 18 at the concrete surface. Optionally, and desirably, the counterweights may be securable (such as via a pin or other retaining or securing element) relative to the track or rail to secure the counterweights when they are moved to the desired location. Optionally, the counterweights may be frictionally retained so as to be not readily movable along the track or rail of the weight or balance adjustment system. The counterweights may slide freely (or substantially freely) along the track or rail or the track or rail may be indexed or notched so that the counterweights may be indexed along the track or rail in prescribed incremental distances.

Thus, the screeding machine provides counterweights to adjust the fore-aft balance of the machine and to adjust the amount of down-pressure of the floating vibrator against the screeded surface of the concrete, whereby the counterweights are adjustably mounted to the support structure of the wheeled unit and screeding machine and may be readily accessible by the operator. Adjustment of the longitudinal location of the counterweights along the wheeled unit is accomplished by sliding and securing a selected number of individual counterweights to a desired location or locations along the track-like support, where the track-like support extends generally horizontally along the surface of the concrete being screeded and in the direction of travel of the machine, and generally perpendicular to the longitudinal axis of the vibratory member and screed head. The counterweights may be generally retained at the desired locations, such as via friction or notches or other suitable retaining means, to limit or substantially preclude movement of the counterweights along the track or rail during operation of the screeding device.

Optionally, and desirably, the screeding head or screed head assembly 14 is pivotable relative to the frame of the wheeled unit 20 (FIG. 3) and pivotable about the longitudinal pivot axis 20*a*. In the illustrated embodiment, the screed head assembly 14 is pivotally mounted to the outer end (the end of the lift arms distal from the wheeled unit) of the lift arms 20 via the pivot joint 19 established at mounting plate 19*a* and mounting stanchion 19*b*, discussed above, so that it is pivotable about the longitudinal pivot axis 20*a* that extends generally longitudinally along the screeding device and generally in the direction of travel of the screeding device. The screed head assembly thus may pivot at the outer end of the mounting frame or lift arm assembly, whereby the axis of rotation for pivoting the screed head is both generally horizontally along the surface of the concrete and generally perpendicular to the lateral axis 18*a* of the vibratory member 18 of the screed head. Such a pivoting feature provides the screed head with angular freedom to move or pivot relative to the support frame and lift arms of the machine. Such angular freedom allows the screed head assembly to roll or pivot and follow the correct grade elevation of the screeded concrete surface while the machine moves along and through the concrete and while the spaced-apart drive wheels of the wheeled unit encounter a typically uneven subgrade surface. Thus, the wheeled unit may tilt in a side-to-side manner as it encounters uneven terrain, while the screed head assembly may tilt or pivot relative to the wheeled unit to maintain a level orientation of the plow and vibrating member (or to maintain the orientation of the plow and vibrating member at the desired angle or slope or profile) as the wheeled unit encounters uneven terrain.

Although shown and described as being pivotally mounted at the outer or distal end of the lift arm and pivotable relative to the lift arm about the longitudinal pivot axis, it is envisioned that the screed head assembly may be otherwise pivotable relative to the wheeled unit and about a longitudinal pivot axis while remaining within the spirit and scope of the present invention. For example, the opposite or proximate end of the lift arm (the end that is proximate to and mounts to the wheeled unit) may be pivotally mounted to the wheeled unit and pivotable about a longitudinal axis relative to the wheeled unit, or the lift arm itself may incorporate a pivot joint that allows for pivotal movement of an outer or distal portion of the lift arm (with the screed head assembly attached thereto) relative to an inner or proximate portion of the lift arm (and relative to the wheeled unit to which the inner lift arm portion is attached) about a longitudinal pivot axis that extends generally in a direction of travel of the screeding device.

Such a pivot configuration allows the screed head assembly to pivot relative to the wheeled unit so that, for example, the screed head assembly may remain generally or substantially horizontal when one of the wheels of the wheeled unit encounters uneven terrain (such as, for example, a bump or depression) causing the wheeled unit to tilt toward one side or the other. By providing for such pivotal movement of the screed head assembly relative to the wheeled unit, the screed head assembly pivots or does not pivot irrespective of non-pivoting or pivoting of the body or frame of the wheeled unit.

Such a pivot configuration can be particularly suitable for a screeding device in three dimensional profiling or contouring applications, where the wheeled unit may be moved along a tilted or sloped support surface. In such applications, if the screed head assembly were to pivot with the body or frame of the wheeled unit (and relative to the axle or wheels of the wheeled unit, such as if the frame of the wheeled unit were pivotally mounted to the axle of the wheeled unit), the higher center of gravity of the heavier body or frame of the wheeled unit would result in the body or frame of the wheeled unit tending to tilt or pivot about the longitudinal pivot axis relative to the wheels and axle, such as when the wheeled unit is moved along a sloped support surface with one wheel being at a lower level than the other wheel. Such tilting or pivoting of the body or frame of the wheeled unit would impart a corresponding pivotal movement to the screed head assembly as well, which may cause the screed head assembly to not track the desired grade or profile of the concrete surface. However, by providing a longitudinal pivot axis or pivot joint between the screed head assembly and the body or frame of the wheeled support (such as at the lift arm), the pivotable screed head assembly has a lower center of gravity and is lighter than the relatively larger body or frame of the wheeled unit, and may more freely pivot relative to the body, frame, wheels and axle of the wheeled support. Thus, even if the body or frame of the wheeled unit may pivot or tilt relative to the ground or support surface as the screeding device is moved along a tilted or sloped support surface, the screed head may not pivot with the wheeled support and thus may more accurately track the desired profile of the concrete surface being worked or finished irrespective of any tilting of the wheeled unit. The present invention thus provides enhanced control and stability of the screed head assembly in establishing the desired grade of the concrete, particularly in applications where the wheeled unit may be moved along an uneven or non-horizontal or sloped support surface, such as may be encountered during the screeding of sloped or elevated parking decks, three dimensional profiling applications, sloped contouring applications and/or the like (and such as while utilizing aspects of the screeding devices described in U.S. Pat. No. 6,227,761, entitled APPARATUS AND METHOD FOR THREE-DIMENSIONAL CONTOURING, which is hereby incorporated herein by reference in its entirety).

Figure 8:
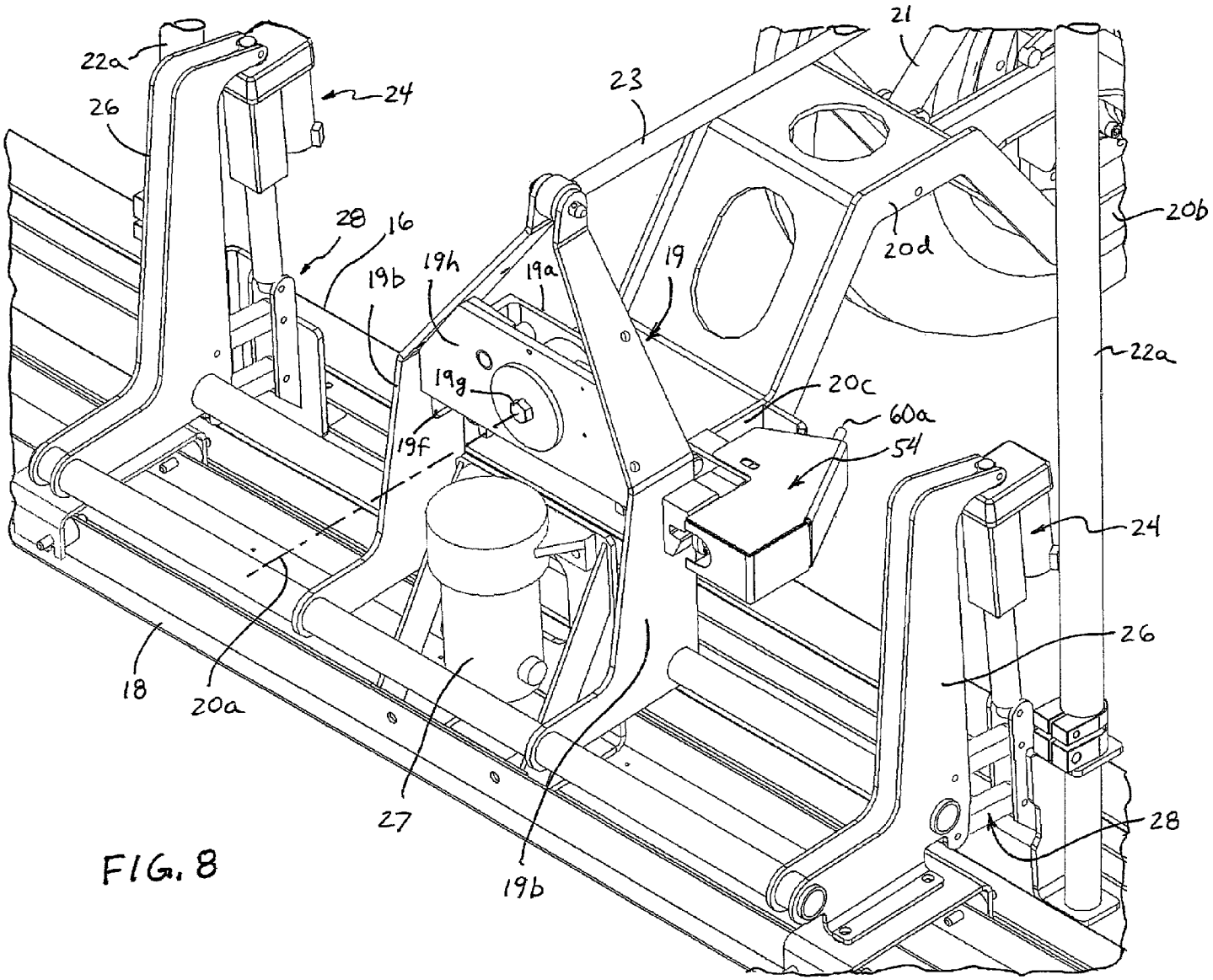
FIG. 8 is an enlarged perspective view of the junction between the lift aim and the screed head assembly of the screeding device of FIGS. 1-6.
Figure 9B:
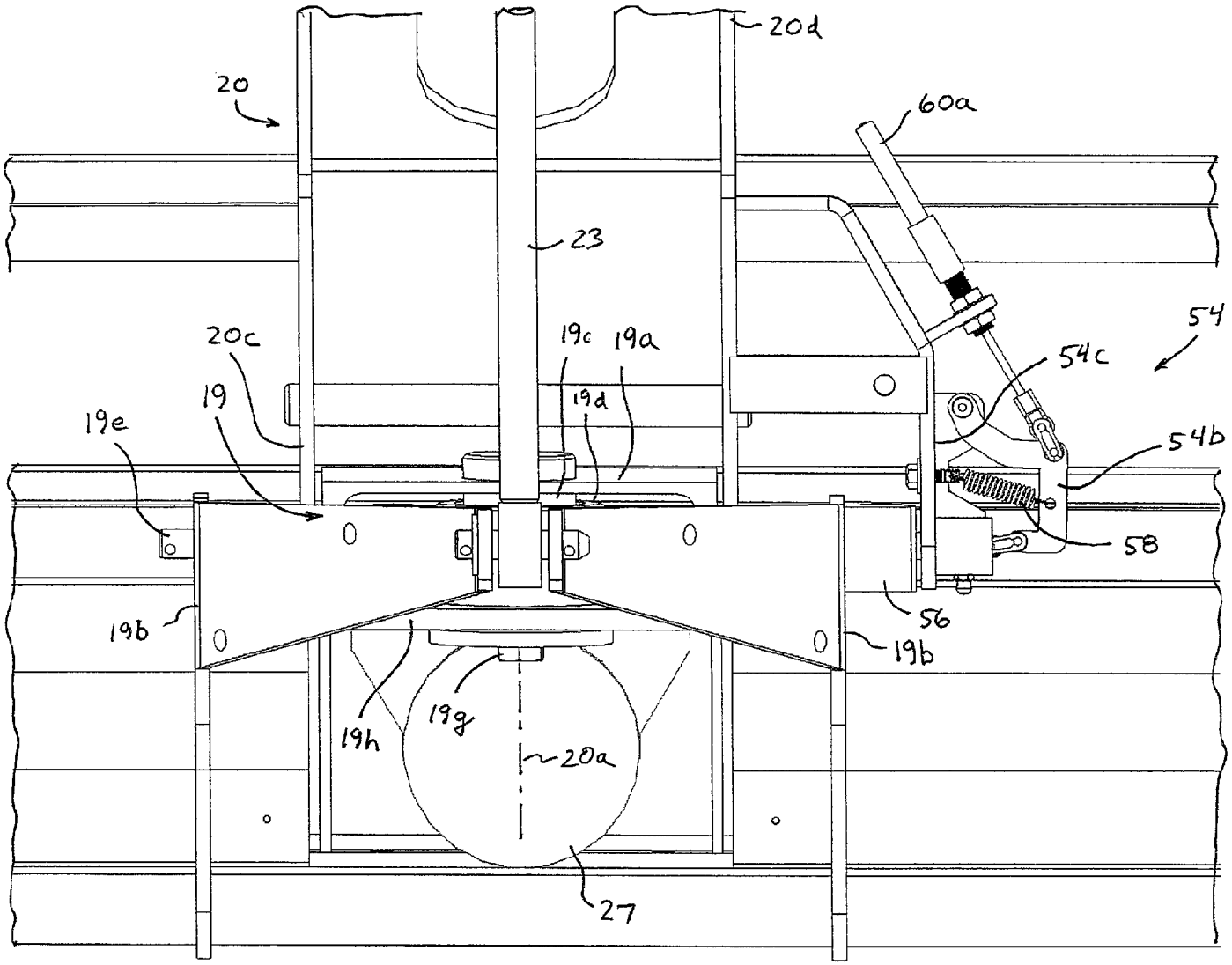
FIG. 9B is a top plan view of the locking mechanism of FIG. 9A.
Figure 9C:
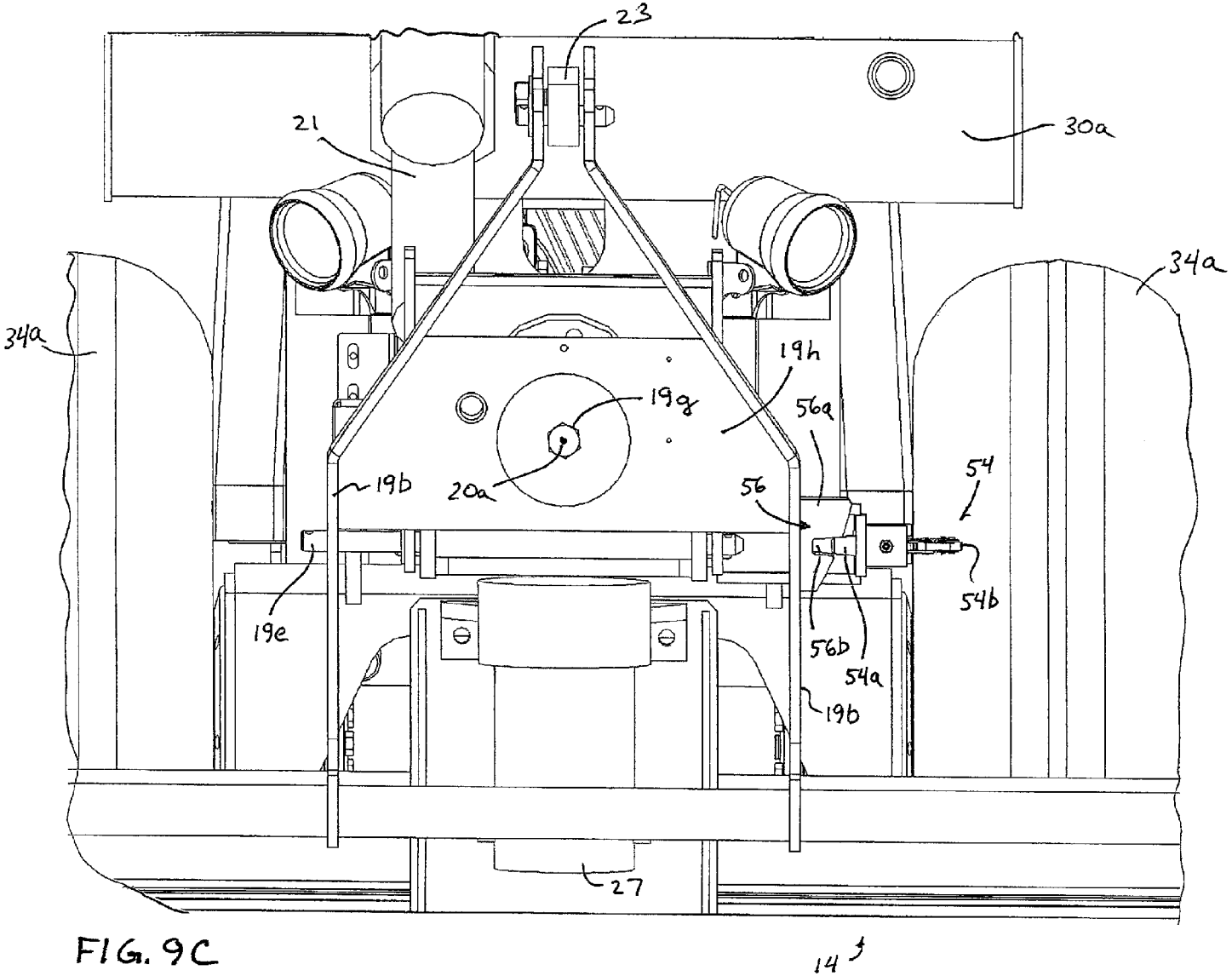
FIG. 9C is an enlarged front elevation of the screeding device showing the locking mechanism of FIGS. 9A and 9B.

Optionally, the screed head assembly may generally freely pivot relative to the wheeled unit during operation of the screeding device, and may be selectively locked or retained at a particular orientation relative to the wheeled support, such as for transporting the screeding device between work areas. For example, and with reference to FIGS. 8-10, screeding device 10 may include a locking mechanism 54 at lift arm 20 that is selectively engaged with a locking element 56 at mounting bracket or stanchion 19*b* of screed head assembly 14. In the illustrated embodiment, locking mechanism 54 comprises a locking element or pin 54*a* that is movable between a locking or engaged position and an unlocking or disengaged position and relative to locking element 56, which comprises a block 56*a* having a channel 56*b* formed therealong for receiving locking pin 54*a* when in its engaged position. The locking pin 54*a* is pivotally mounted to or attached to a linkage mechanism 54*b* which, in turn, is pivotally mounted to a bracket 54*c* at distal end 20*c* of lift arm 20. Optionally, a biasing element or spring 58 is attached between the linkage mechanism 54*b* and the bracket 54*c* to bias or urge the pin toward a locking or engaging position. A cable or actuating element (only the end portions of the cable are shown in the drawings for purposes of clarity of the drawings) has one end 60*a* connected to linkage mechanism 54*b* and pulls or moves linkage mechanism 54*b* so as to pivot the linkage mechanism relative to bracket 54*c* to move pin 54*a* relative to locking element 56. The opposite end 60*b* of the cable is connected to a control or lever or actuator 62 at control panel 40, whereby an operator may pull or move the lever 62 to move the pin 54*a* relative to the locking element 56.

Thus, pin 54*a* may be received within channel 56*b* of block 56*a* at mounting stanchion 19*b* to retain screed head assembly 14 relative to lift arm 20 in a non-pivotal manner, thereby easing transport of the screeding device when the screed head assembly is raised and not in a screeding operation. The biasing element 58 biases or urges pin 54*a* into channel 56*b* to retain the pin within the channel. When it is desired to release the screed head assembly to allow pivotal movement of the screed head assembly about the longitudinal pivot axis 20*a*, an operator may selectively pull or move lever 62 at control panel 40 (such as along a slot formed in a cover plate of the control panel) to pull at the cable to retract pin 54*a* from channel 56*b*. When the pin has been retracted from the channel, the lever 62 may be moved into a notch along the slot to limit movement of the lever 62 so as to retain the pin 54*a* in its retracted position. Thus, the screeding head assembly may pivot about the longitudinal pivot axis 20*a* (within the pivotal range or limits that may be established by the pivot axle 19*e* and the notch 19*f* discussed above) during operation of the screeding device or machine. When it is desired to re-lock the screed head assembly 14 relative to the lift arm 20, the operator may move the lever 62 out of the notch and move or allow the lever to move along the slot at the control panel, whereby the biasing element will urge the pin toward its engaging position after the lever is removed from the control panel retaining notch. Then, once the screed head assembly pivots about the longitudinal pivot axis so that the channel 56*b* is generally aligned with pin 54*a*, the pin will be urged into the channel to substantially lock the screed head assembly relative to the lift aim. The operator may then readily move the screeding device with the screed head assembly raised above the concrete and support surface, such as to position the screeding device for a next screeding pass or the like.

During use of wheeled screeding device 10, an operator drives or otherwise moves wheeled screeding device 10 to move the wheels along and through the uncured concrete surface and to move vibrating beam 18 and the plow 16 over the uncured concrete surface to consolidate, smooth, level and/or flatten the surface at a desired grade. As discussed above, the plow is adjusted relative to the vibratory member to strike off the concrete in front of the vibratory member to the desired grade in response to the elevation actuators extending or retracting in response to an output of the laser receivers mounted to the rods extending upward from the vibratory member. Optionally, the elevation actuators may be occasionally correspondingly operable in response to a signal from only one of the laser receivers, such as in situations where the laser beam reference plane may be temporarily blocked from being received, such as described in U.S. Pat. No. 5,556,226, which is hereby incorporated herein by reference in its entirety. Optionally, the elevation actuators may be controlled by other means or control systems, such as a three dimensional profiler system (such as a 3-D Profiler System commercially available from Somero Enterprises, Inc.), such as disclosed in U.S. Pat. No. 6,227,761, which is hereby incorporated herein by reference in its entirety.

Optionally, the two electric actuators that control the elevation of the grade setting member or plow may be actively electrically controlled by the screed elevation control system during column-block conditions (where one of the two laser receivers is not able to receive a laser plane reference signal) to lock in a temporary fixed position. With such a control system, the electric actuator corresponding to the laser receiver that is not receiving a laser reference signal is not simply turned off, but is actively locked in its current position by the controller, whereby the actuator motor may receive both a "raise" signal and a "lower" signal at the same time, thus actively and more securely locking the actuator in a temporary holding position until the column block mode conditions has passed and normal elevation raise-lower control mode is re-instated and resumed by the control system. Such a system may utilize aspects of the systems described in U.S. Pat. No. 5,556,226, issued to Hohmann on Sep. 17, 1996, which is hereby incorporated herein by reference in its entirety. Such a control system provides a more effective method of holding the actuator at the desired position, rather than simply turning off or cutting the respective raise or lower current-voltage signals to the motor windings. Applying the current-voltage to both the motor windings is a preferred method of locking the actuator or actuators at the desired position (by active electrical locking of the actuator), rather than relying on the mechanical friction of the components (such as the worm drive gears of the motor) within the device to resist external forces that could cause the actuator to move out of the desired position. This method of locking is generally known by electric linear actuator manufacturers.

Optionally, the screed elevation laser receivers used with screeding machine 10 may include an "easy reset" feature that allows the operator of the machine to quickly reset the zero-point or desired grade setting of the laser receiver back to the center portion of the vertical sensing range of the laser receiver's optical sensor. Such a reset feature makes it easier for the operator to cancel any elevation offset settings that may have been entered into or programmed into the screed elevation controller.

Optionally, the screeding machine may provide a locked plow elevation function or feature, which allows the operator to automatically and temporarily suspend automatic control of the plow elevation actuators (and/or the screed head elevation actuator), while driving or moving the machine around on the job site from one location to another. In effect, the control of the plow elevation actuators may be automatically switched to a "manual mode" from an "automatic mode" whenever the forward mode of the drive control or input is activated to drive the machine in the forward (non-screeding) direction (such as whenever the forward mode of a "FWD/REV" wheel drive rocker switch at control panel 40 is activated). When in the manual mode, the screed head plow elevation actuators are electrically locked in a fixed position, but can be manually adjusted by the operator, such as by using one or more manual raise-lower rocker switches at the control panel. Such a control system makes it easier to handle the machine when not screeding because the control system is then not attempting to make plow elevation corrections while the machine is simply being moved, either from place to place, or in the forward direction, while in preparation to get into position for the next reverse (screeding) pass. The switch to the manual mode may occur when the "FWD/REV" wheel drive rocker switch is activated to drive the machine in the forward (non-screeding) direction, and when a dead man handlebar switch/lever (at one of the handgrips of the machine) is held in the depressed (active) position by the operator's hand while driving or operating the screeding machine. Optionally, the locking of the plow elevation actuators may be accomplished in both the automatic and manual control modes by applying the current-voltage signal to both the raise and lower windings within the motor of the electric actuator at the same time, such as discussed above.

Ideally, fresh concrete is placed in an area to be screeded generally averaging between about zero to about ½ inch higher than the desired finished elevation. If the accuracy of the concrete placement is poor, both high and low areas are usually apparent in the placed concrete and the average amount of material will be too high or too low. Workers with concrete rakes and shovels are typically needed to fill in the voids and cut down the high spots just ahead of the plow of the machine as it advances. With an excessively high placement of fresh concrete, manual raking in advance of the machine must move the extra material away. When the concrete is too high, the excess material will very rapidly build up against the plow, quickly exceeding the screeding capabilities of the machine.

Accordingly, the screeding device or machine 10 may be operable in either a normal mode or a quick-pass or pre-screeding mode or method or process that temporarily adjusts and uses the screeding device to quickly remove excess concrete from an area to be screeded. The screed elevation control system thus may include an operator-selected control mode whereby the desired grade elevation is quickly and temporarily increased by approximately ½ inch (or about 12.7 mm or other offset as may be desired) above the normally desired grade elevation. This mode of operation effectively resets the on-grade sensing range of the laser receivers at an offset position of about ½ inch (or about 12.7 mm or other offset as may be desired) lower than normal. This mode of temporary operation allows the operator to make selective "quick" screeding passes to quickly strike-off excess amounts of concrete from an area to be screeded before the final screed pass is made at the normally desired grade elevation.

Therefore, the present invention provides a lightweight, easily maneuverable screeding device that is operable to consolidate, smooth, level and/or screed uncured concrete, and that is ideally suited for use on elevated deck surfaces as well as residential concrete construction. Because the screeding machine is a light-weight wheel-driven unit, such as at a nominal weight of less than about 450 lbs (about 204.1 kg), such as about 350 lbs to about 400 lbs (about 159 kg to about 181.4 kg), the screeding machine of the present invention is suitable for screeding concrete by driving a wheeled machine over a concrete slabs where post-tensioned cables have been installed within the concrete. The actual weight of the machine may vary (and may be greater or less than the above exemplary weights) depending on the design of the components and the particular materials that are selected for the machine (such as for different types of applications or desired performance of the machine or the like), while remaining within the spirit and scope of the present invention. The screeding machine and method of screeding of the present invention can be more productive and less tiring to use for the concrete screeding operator and construction crew than using non-wheeled or hand-held screeding tools or devices. The screeding machine is moved over and through the uncured concrete placed at and over the cables, whereby the screeding machine moves over and along or across the cables disposed within the placed and uncured concrete. After the concrete is screeded by the screeding machine, and after the concrete is at least partially cured, the cables are tensioned to stress the concrete in compression to provide enhanced strength to the concrete.

The size of the screeding machine of the present invention also allows for easy transportation of the screeding machine between screeding sites. For example, the wheeled unit may be about 30 inches (about 76.2 cm) wide and may be about 56 inches (about 142.3 cm) long and may be about 42 inches (about 106.7 cm) high (or other dimensions depending on the particular application). The screeding head may be readily detached from the wheeled unit (and may not require any hydraulic disconnections), whereby the wheeled unit and screeding head (which are smaller and lighter than other known devices) may be placed in a bed of a pickup truck for transportation between screeding sites.

The screeding device or machine of the present invention is easily movable, steered and/or pulled by an operator over the uncured concrete surface (and over the cables disposed within the placed and uncured concrete), while the vibrating beam or member vibrates to smooth and compact the concrete at the surface as it is supported thereon. The strike-off plow or other grade setting element or device is positioned along a forward edge of the vibrating beam to establish or cut the grade of the uncured concrete to a desired grade or level. The weight of the screeding head at least partially rests upon the uncured concrete surface, while a pair of wheels at least partially supports components of the screeding device and enhances the mobility and maneuverability of the screeding device. Optionally, the wheels may be powered or driven (such as via a single drive motor) to further enhance the mobility, maneuverability, work output, and usefulness of the screeding device.

The screeding device or machine of the present invention thus provides laser controlled accuracy and may screed the concrete to higher tolerances than conventional methods and provides better concrete consolidation than hand-held vibratory screeds. The screeding machine of the present invention is lightweight and readily maneuvered at the screeding site, and is easy to set-up, disassemble and transport.

Optionally, and with reference to FIGS. 11-17, a lightweight wheeled screeding device 110 includes a wheeled support device or assembly or unit 112, which movably supports a screeding head 114, which includes a grade setting device or element, such as a strike-off plow 116, and a vibratory beam or member 118, and which is adjustably mounted to the wheeled support unit 112 via a mounting frame or lift arm or arms 120, such as in a similar manner as described above. The lightweight wheeled screeding device 110 is operable by an operator to move over and through or along uncured concrete, while the plow 116 functions to strike off the concrete to the desired grade in front of vibratory member 118 (such as in response to a pair of laser receivers 122 mounted to the plow 116 and a pair of elevation devices or actuators 124 operable to adjust the elevation of the plow 116 relative to the vibratory member 118) and the vibratory member 118 floats or is at least partially supported on the uncured concrete surface and screeds and smoothes the struck-off concrete surface as the wheeled screeding device 110 is moved along the uncured concrete, such as in a similar manner as described above.

The screeding head 114 is adjustably mounted to the wheeled unit 112 via the mounting frame or lift arms 120, which may pivot relative to wheeled unit 112 and screeding head 114 to provide for vertical movement or raising/lowering of screeding head 114 relative to the wheeled unit 112. In the illustrated embodiment, the lift arm comprises a generally straight lift arm, but could comprise a curved or raised lift arm to provide clearance at the front of the plow for clearing excess concrete from in front of the plow, such as described above with respect to screeding device 10. The screeding head 114 may pivot relative to the wheeled unit 112, such as relative to the outer end of the lift arm 120, and about a longitudinal pivot axis 120*a* that extends longitudinally in the direction of travel of the screeding device, such as in a similar manner as described above.

In the illustrated embodiment, the axle 132 of wheeled unit 112 of screeding machine 110 supports a pair of spaced apart wheels 134, with the wheels being arranged inboard of the lateral sides or outer frame members of frame 130 and being driven via a single drive motor 136, such as a hydraulic drive motor or other suitable rotational drive motor. In the illustrated embodiment, the single drive motor 136 is located laterally outboard of one of the wheels 134 and is operable to rotatably drive both wheels about the axis of the wheel axle 132.

Optionally, the two wheels 134 or drive wheels of screeding machine 110 may be mechanically secured in close proximity to one another and may rotate together as one unit or single wheel. Thus, such a wheel arrangement may provide the characteristics and advantages of two separately driven narrow wheels, as well as providing the mechanical simplicity of a single drive wheel. Each wheel 134 includes a respective pneumatic tire 134*a* (such as 90/100×14 inch off road motorcycle tires or 25×8×12 inch ATV tires or any other suitable tires) mounted onto the wheel hub structure, whereby the result may be similar to a single wheel but with two points of contact with the ground or subgrade while the machine screeds the concrete.

Screeding device 110 may otherwise be substantially similar in construction and operation to screeding device 10, discussed above, such that a detailed discussion of the screeding devices need not be repeated herein. The components of screeding device 110 that are common or similar to those of screeding device 10 are referenced in FIGS. 11-17 with similar reference numbers, but with 100 added to the reference numbers of FIGS. 11-17.

Changes and modifications in the specifically described embodiments may be carried out without departing from the principles of the present invention, which is intended to be limited only by the scope of the appended claims, as interpreted according to the principles of patent law.

The invention claimed is:

1. A wheeled screeding device movable over and through a surface of uncured concrete and operable to level and smooth the uncured concrete surface, said wheeled screeding device comprising:

a wheeled support having a frame portion and a pair of spaced apart wheels rotatably mounted to said frame portion, a screed head mounted to said wheeled support, said screed head comprising a vibrating member and a grade setting device adjustably mounted to said vibrating member, said vibrating member being at least partially supportable on the uncured concrete surface as said wheeled screeding device moves over and through the uncured concrete, said wheeled support being partially supportable upon and over post-tensioned cables at the support surface;

said grade setting device being adjustable relative to said vibrating member to establish a desired grade of the concrete surface in front of said vibrating member in the direction of travel of said device as said wheeled screeding device as said wheeled scredding device is operated to level and smooth the uncured concrete surface;

wherein said screed head is pivotable about a longitudinal pivot axis relative to said wheeled support, said longitudinal pivot axis extending along said wheeled screeding device and in the direction of travel of said wheeled screeding device, said screed head being pivotable about said longitudinal pivot axis to screed the concrete surface and follow a targeted grade elevation while said spaced apart wheels engage uneven terrain; and a pivot limiting element that selectively limits pivotal movement of said screed head about said longitudinal pivot axis, wherein said pivot limiting element limits pivotal movement of said screed head about said longitudinal pivot axis when in a locking position and allows pivotal movement of said screed head about said longitudinal pivot axis when in an unlocking position, said pivot limiting element being movable between said locking and unlocking positions in response to a user input.

2. A wheeled screeding device movable over and through a surface of uncured concrete and operable to level and smooth the uncured concrete surface, said wheeled screeding device comprising:

a wheeled support having a frame portion and a pair of spaced apart wheels rotatably mounted to said frame portion;

a screed head mounted to said wheeled support, said screed head comprising a vibrating member and a grade setting device adjustably mounted to said vibrating member, said vibrating member being at least partially supportable on the uncured concrete surface as said wheeled screeding device moves over and through the uncured concrete, said wheeled support being partially supportable upon and over post-tensioned cables at the support surface;

said grade setting device being adjustable relative to said vibrating member to establish a desired grade of the concrete surface in front of said vibrating member in the direction of travel of said wheeled screeding device as said wheeled screeding device is operated to level and smooth the uncured concrete surface;

wherein said screed head is pivotable about a longitudinal pivot axis relative to said wheeled support, said longitudinal pivot axis extending along said wheeled screeding device and in the direction of travel of said wheeled screeding device, said screed head being pivotable about said longitudinal pivot axis to screed the concrete surface and follow a targeted grade elevation while said spaced apart wheels engage uneven terrain; and wherein said wheeled screeding device is partially balanced about said spaced apart wheels and includes at least one counterweight that is movable along a longitudinally oriented support of said wheeled support, said at least one counterweight being movable along said longitudinally oriented support to adjust a down pressure of said vibrating member at the uncured concrete surface.

3. A wheeled screeding device movable over and through a surface of uncured concrete and operable to level and smooth the uncured concrete surface, said wheeled screeding device comprising:

a wheeled support having a frame portion and a pair of spaced apart wheels rotatably mounted to said frame portion;

a screed head mounted to said wheeled support, said screed head comprising a vibrating member and a grade setting device adjustably mounted to said vibrating member, said vibrating member being at least partially supportable on the uncured concrete surface as said wheeled screeding device moves over and through the uncured concrete, said wheeled support being partially supportable upon and over post-tensioned cables at the support surface;

said grade setting device being adjustable relative to said vibrating member to establish a desired grade of the concrete surface in front of said vibrating member in the direction of travel of said wheeled screeding device as said wheeled screeding device is operated to level and smooth the uncured concrete surface; and wherein said screed head is pivotable about a longitudinal pivot axis relative to said wheeled support, said longitudinal pivot axis extending along said wheeled screeding device and in the direction of travel of said wheeled screeding device, said screed head being pivotable about said longitudinal pivot axis to screed the concrete surface and follow a targeted grade elevation while said spaced apart wheels engage uneven terrain.

4. The wheeled screeding device of claim 3, wherein said screed head is mounted to a lift arm that is pivotally mounted to said wheeled support and pivotable about a lateral pivot axis to raise and lower said screed head relative to said wheeled support.

5. The wheeled screeding device of claim 4, wherein said screed head is pivotally mounted to said lift arm and pivotable about said longitudinal pivot axis relative to said lift arm.

6. The wheeled screeding device of claim 5, wherein said screed head is pivotally mounted to a distal end portion of said lift arm that is distal from said wheeled support.

7. The wheeled screeding device of claim 4, wherein said lift arm comprises a curved lift arm that has a raised central portion to provide enhanced access to the area in front of said grade setting device.

8. The wheeled screeding device of claim 3 further comprising a pivot limiting element that selectively limits pivotal movement of said screed head about said longitudinal pivot axis.

9. The wheeled screeding device of claim 3, wherein said spaced apart wheels are rotatably driven via a single drive motor.

10. The wheeled screeding device of claim 9, wherein rotation of said spaced apart wheels is controlled via a transaxle drive unit that is operable to rotatably drive said wheels at different speeds for steering said wheeled screeding device.

11. The wheeled screeding device of claim 3, wherein adjustment of said grade setting device relative to said vibrating member is in response to a pair of laser receivers mounted at opposite sides of a center region of said vibrating member.

12. The wheeled screeding device of claim 11 further comprising linear actuators at opposite sides of said center region of said vibrating member, said linear actuators being operable in response to said laser receivers to adjust said grade setting device relative to said vibrating member.

13. The wheeled screeding device of claim 12, wherein said linear actuators comprise electrical linear actuators, and wherein at least one of said electrical linear actuators is actively locked by receiving a raise and lower signal at the same time in response to a respective one of said laser receivers not receiving a laser signal.

14. The wheeled screeding device of claim 3, wherein said screed head is removably mounted to said wheeled unit and is detachable therefrom by removing at least one mounting pin.

15. The wheeled screeding device of claim 14, wherein said vibrating member is vibratable via an electrical vibrating device and wherein said grade setting device is adjustable relative to said vibrating member via a pair of electrical linear actuators, and wherein said screed head is removable from said wheeled unit without disconnecting any hydraulic lines of a hydraulic control system of said wheeled screeding device.

16. The wheeled screeding device of claim 3, wherein said wheeled screeding device has a weight of less than 450 lbs (204.1 kg).

17. The wheeled screeding device of claim 3 further comprising a hydraulic motor and hydraulic reservoir, said hydraulic motor operable to rotatably drive at least one of said wheels, wherein a portion of said frame portion comprises said hydraulic reservoir.

18. The wheeled screeding device of claim 3, wherein said screed head is pivotally mounted relative to said wheeled support via a pivot joint that allows for pivotal movement of said screed head relative to said wheeled support about a pivot axis of said pivot joint, and wherein said pivot axis of said pivot joint is generally parallel to said longitudinal pivot axis.

19. The wheeled screeding device of claim 18, further comprising a lift arm that is pivotally mounted at said wheeled support and is pivotable about a lateral pivot axis to raise and lower said screed head relative to said wheeled support.

20. The wheeled screeding device of claim 19, wherein said lift arm has an inner end and an outer end and wherein said pivot joint is at said outer end of said lift arm and said inner end of said lift arm is pivotally mounted at said wheeled support and pivotable about said lateral pivot axis.

21. The wheeled screeding device of claim 20, wherein said vibrating member is pivotally mounted to said wheeled screeding device via said pivot joint.

22. The wheeled screeding device of claim 21, wherein said screed head comprises a pair of actuators operable to adjust said grade setting device relative to said vibrating member to establish the desired grade of the concrete surface in front of said vibrating member in the direction of travel of said wheeled screeding device as said wheeled screeding device is operated to level and smooth the uncured concrete surface.

23. The wheeled screeding device of claim 22, wherein said grade setting device is adjustably mounted to said vibrating member via said pair of actuators.

24. The wheeled screeding device of claim 18, wherein said pivot joint comprises a cylindrical bushing element that is at least partially received at a generally cylindrical collar element.

25. The wheeled screeding device of claim 3, wherein said screed head pivots about said longitudinal pivot axis to screed the concrete surface and to follow a targeted grade elevation when said spaced apart wheels engage uneven terrain, whereby said screed head follows the targeted grade elevation irrespective of a levelness of the support surface upon which said wheeled screeding device is moved.

* * * * *

UNITED STATES PATENT AND TRADEMARK OFFICE

CERTIFICATE OF CORRECTION

PATENT NO. : 7,850,396 B2
APPLICATION NO. : 12/345164
DATED : December 14, 2010
INVENTOR(S) : Mark A. Pietila et al.

It is certified that error appears in the above-identified patent and that said Letters Patent is hereby corrected as shown below:

Column 3
Line 62, “aim” should be --arm--

Column 14
Line 30, “aim” should be --arm--

Column 15
Line 3, “conditions” should be --condition--

Column 18
Claim 1, Line 37, “portion,” should be --portion;--
Claim 1, Line 50, Insert --wheeled screeding-- after “of said”
Claim 1, Line 51, Delete “as said wheeled scredding device” after “device”

Signed and Sealed this
Twenty-second Day of November, 2011

David J. Kappos

David J. Kappos
*Director of the United States Patent and Trademark Office*